US012098661B2

(12) United States Patent
Wollenberg et al.

(10) Patent No.: US 12,098,661 B2
(45) Date of Patent: Sep. 24, 2024

(54) CAM PHASE ACTUATOR CONTROL SYSTEMS AND METHODS

(71) Applicant: HUSCO Automotive Holdings LLC, Waukesha, WI (US)

(72) Inventors: Todd Wollenberg, Milwaukee, WI (US); Patrick Heithoff, Sussex, WI (US); Brian Griffiths, Milwaukee, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 0 days.

(21) Appl. No.: 18/386,506

(22) Filed: Nov. 2, 2023

(65) Prior Publication Data

US 2024/0141811 A1 May 2, 2024

Related U.S. Application Data

(60) Provisional application No. 63/421,909, filed on Nov. 2, 2022.

(51) Int. Cl.
*F01L 1/344* (2006.01)

(52) U.S. Cl.
CPC ..... *F01L 1/344* (2013.01)

(58) Field of Classification Search
CPC ..... F01L 1/344; F01L 2201/00
See application file for complete search history.

(56) References Cited

U.S. PATENT DOCUMENTS

| | | | |
|---|---|---|---|
| 4,986,801 | A | 1/1991 | Ohlendorf et al. |
| 5,078,647 | A | 1/1992 | Hampton |
| 5,119,691 | A | 6/1992 | Lichti et al. |
| 5,125,372 | A | 6/1992 | Gondek |
| 5,163,872 | A | 11/1992 | Niemiec et al. |
| 5,234,088 | A | 8/1993 | Hampton |
| 5,235,941 | A | 8/1993 | Hampton |
| 5,272,937 | A | 12/1993 | Brosowske et al. |
| 5,305,717 | A | 4/1994 | Wichelhaus |
| 5,305,719 | A | 4/1994 | Clarke et al. |
| 5,337,711 | A | 8/1994 | Hampton |
| 5,588,404 | A | 12/1996 | Lichti et al. |
| 5,803,030 | A | 9/1998 | Cole |
| 5,934,263 | A | 8/1999 | Russ et al. |

(Continued)

FOREIGN PATENT DOCUMENTS

| | | | | |
|---|---|---|---|---|
| CN | 102003292 A | * | 4/2011 | ..... F01L 1/3442 |
| CN | 102562209 A | | 7/2012 | |

(Continued)

*Primary Examiner* — Ngoc T Nguyen
(74) *Attorney, Agent, or Firm* — Quarles & Brady LLP

(57) ABSTRACT

A control system for a cam phaser can include a cam phaser coupled to a cam shaft, the cam phaser to adjust a position of the cam shaft, an actuator in mechanical communication with the cam phaser, and a controller in electrical communication with the actuator, the controller including a processor and a memory. In one example, the processor is configured to calculate a first hysteresis position of the actuator with respect to a hysteresis band, determine if the actuator is within a first threshold distance of a first edge of the hysteresis band, and if the actuator is not within the first threshold distance of the first edge of the hysteresis band, command the actuator to displace across the hysteresis band.

19 Claims, 20 Drawing Sheets

(56) References Cited

U.S. PATENT DOCUMENTS

| | | | |
|---|---|---|---|
| 5,947,070 | A | 9/1999 | Immel et al. |
| 6,192,842 | B1 | 2/2001 | Haag |
| 6,213,071 | B1 | 4/2001 | Lancefield et al. |
| 6,250,267 | B1 | 6/2001 | Methley |
| 6,253,720 | B1 | 7/2001 | Lancefield et al. |
| 6,328,008 | B1 | 12/2001 | Io |
| 6,363,896 | B1 | 4/2002 | Speier |
| 6,390,045 | B1 | 5/2002 | Mae et al. |
| 6,422,188 | B2 | 7/2002 | Pierik |
| 6,932,036 | B2 | 8/2005 | Aino et al. |
| 7,086,359 | B2 | 8/2006 | Hayase et al. |
| 7,201,122 | B2 | 4/2007 | Schmidt |
| 7,305,949 | B2 | 12/2007 | McCarthy et al. |
| 7,481,191 | B2 | 1/2009 | Watanabe et al. |
| 7,581,316 | B2 | 9/2009 | Grunow |
| 7,614,370 | B2 | 11/2009 | Fischer et al. |
| 7,721,692 | B2 | 5/2010 | Fischer |
| 7,751,967 | B2 | 7/2010 | Grai et al. |
| 8,025,035 | B2 | 9/2011 | Berger |
| 8,042,504 | B2 | 10/2011 | Berger |
| 8,505,372 | B2 | 8/2013 | Cho et al. |
| 9,228,456 | B2 | 1/2016 | Gross et al. |
| 9,708,942 | B2 | 7/2017 | Zurface et al. |
| 10,072,537 | B2 | 9/2018 | Schmitt et al. |
| 10,344,631 | B2 | 7/2019 | Schmitt et al. |
| 10,371,018 | B2 | 8/2019 | Pochner et al. |
| 10,557,383 | B2 | 2/2020 | Schmitt et al. |
| 10,711,657 | B2 | 7/2020 | Schmitt et al. |
| 10,865,665 | B2 | 12/2020 | Schmitt et al. |
| 2002/0088416 | A1 | 7/2002 | Nakamura et al. |
| 2003/0131812 | A1 | 7/2003 | Hosoya |
| 2003/0159670 | A1 | 8/2003 | Simpson et al. |
| 2003/0196617 | A1 | 10/2003 | Simpson et al. |
| 2007/0283911 | A1 | 12/2007 | Nakamura et al. |
| 2008/0011253 | A1 | 1/2008 | Nakamura |
| 2008/0172160 | A1 | 7/2008 | Jiang et al. |
| 2009/0043483 | A1 | 2/2009 | Abe et al. |
| 2009/0198437 | A1 | 8/2009 | Mladenovic et al. |
| 2009/0255497 | A1 | 10/2009 | Davis |
| 2010/0236523 | A1 | 9/2010 | Saruwatari et al. |
| 2011/0048350 | A1 | 3/2011 | Simpson et al. |
| 2012/0285405 | A1 | 11/2012 | Pierik |
| 2013/0139770 | A1 | 6/2013 | Shogenji et al. |
| 2013/0239918 | A1 | 9/2013 | Nakagawa et al. |
| 2013/0256086 | A1 | 10/2013 | Hou et al. |
| 2016/0186618 | A1 | 6/2016 | Simpson |
| 2016/0327124 | A1 | 11/2016 | McCloy et al. |
| 2017/0022855 | A1 | 1/2017 | Schmitt et al. |
| 2017/0175595 | A1 | 6/2017 | Berndt |
| 2018/0073598 | A1 | 3/2018 | Pluta et al. |
| 2018/0209310 | A1 | 7/2018 | Schmitt et al. |
| 2020/0031346 | A1 | 1/2020 | Lipot et al. |
| 2020/0182106 | A1 | 6/2020 | Kujak et al. |
| 2022/0195898 | A1 | 6/2022 | Van Weelden et al. |
| 2023/0050408 | A1 | 2/2023 | Kujak et al. |
| 2023/0243281 | A1 | 8/2023 | Kujak et al. |

FOREIGN PATENT DOCUMENTS

| | | | | | |
|---|---|---|---|---|---|
| CN | 102588128 | B | * | 6/2015 | ..... F02D 13/0219 |
| DE | 3126620 | A1 | | 2/1982 | |
| DE | 3231503 | A1 | | 3/1984 | |
| DE | 3320835 | A1 | | 12/1984 | |
| DE | 19846354 | A1 | | 4/2000 | |
| DE | 19955507 | A1 | | 6/2001 | |
| DE | 10352362 | A1 | | 6/2005 | |
| DE | 102009012137 | A1 | | 9/2010 | |
| DE | 102010027351 | A1 | | 1/2012 | |
| EP | 0558198 | A1 | | 9/1993 | |
| EP | 0558199 | A1 | | 9/1993 | |
| EP | 0558200 | A1 | | 9/1993 | |
| EP | 1598527 | A2 | | 11/2005 | |
| EP | 1801367 | A1 | | 6/2007 | |
| JP | H10153105 | A | | 6/1998 | |
| JP | 2002357134 | A | | 12/2002 | |
| JP | 2005344724 | A | | 12/2005 | |
| JP | 2007092674 | A | | 4/2007 | |
| JP | 2010001877 | A | | 1/2010 | |
| JP | 2010014097 | A | | 1/2010 | |
| WO | 0123713 | A1 | | 4/2001 | |
| WO | WO-2007042361 | A1 | * | 4/2007 | ..... F01L 1/3442 |
| WO | 2012042408 | A1 | | 4/2012 | |
| WO | 2013020728 | A1 | | 2/2013 | |

* cited by examiner

CAM PHASE ACTUATOR CONTROL SYSTEMS AND METHODS

CROSS-REFERENCE TO RELATED APPLICATION

This application is based on, claims priority to, and incorporates herein by reference in its entirety, U.S. Provisional Patent Application No. 63/421,909, filed Nov. 2, 2022.

BACKGROUND

In general, cam phasing systems include a rotary actuator, or phaser, which is configured to adjust a rotational position of a cam shaft relative to a crank shaft of an internal combustion engine.

SUMMARY

Some embodiments of the invention provide a cam phasing system. The cam phasing system includes a cam phaser coupled between a cam shaft and a crank shaft to control a phase angle of a cam shaft relative to the crank shaft, an actuator coupled to the cam phaser and configured to operate the cam phaser to control the phase angle, and a controller in electrical communication with the actuator, the controller including a processor and a memory. In one example, the processor is configured to calculate a first operating point of the actuator with respect to a hysteresis band of the phasing system, the hysteresis band defining a first static boundary and a second static boundary. The processor is further configured to determine if the actuator is within a first threshold distance of the first static boundary, and if the actuator is outside the first threshold distance of the first static boundary, command the actuator to displace across the hysteresis band to the second static boundary.

Some embodiments of the invention provide a method of controlling a cam phaser system. The method includes calculating, via a processor, a first operating point of an actuator of the cam phasing system, determining, via a processor, whether the actuator is within a first threshold distance of a first static boundary of a hysteresis band, if the actuator is not within the first threshold distance, commanding, via the processor, the actuator to cross the hysteresis band, and once the actuator is within the first threshold distance of the first static boundary of the hysteresis band, driving the actuator to displace a cam shaft of the cam phasing system into a desired position.

Some embodiments of the invention provide a method of controlling a cam phaser system. The method includes monitoring, via an actuator position sensor in communication with a processor, a position of an actuator of the cam phasing system, determining, via the processor, whether the position of the actuator is outside of a hysteresis band of the cam phasing system, and if the position of the actuator is outside of the hysteresis band, updating, via the processor, the hysteresis band to include the position of the actuator.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
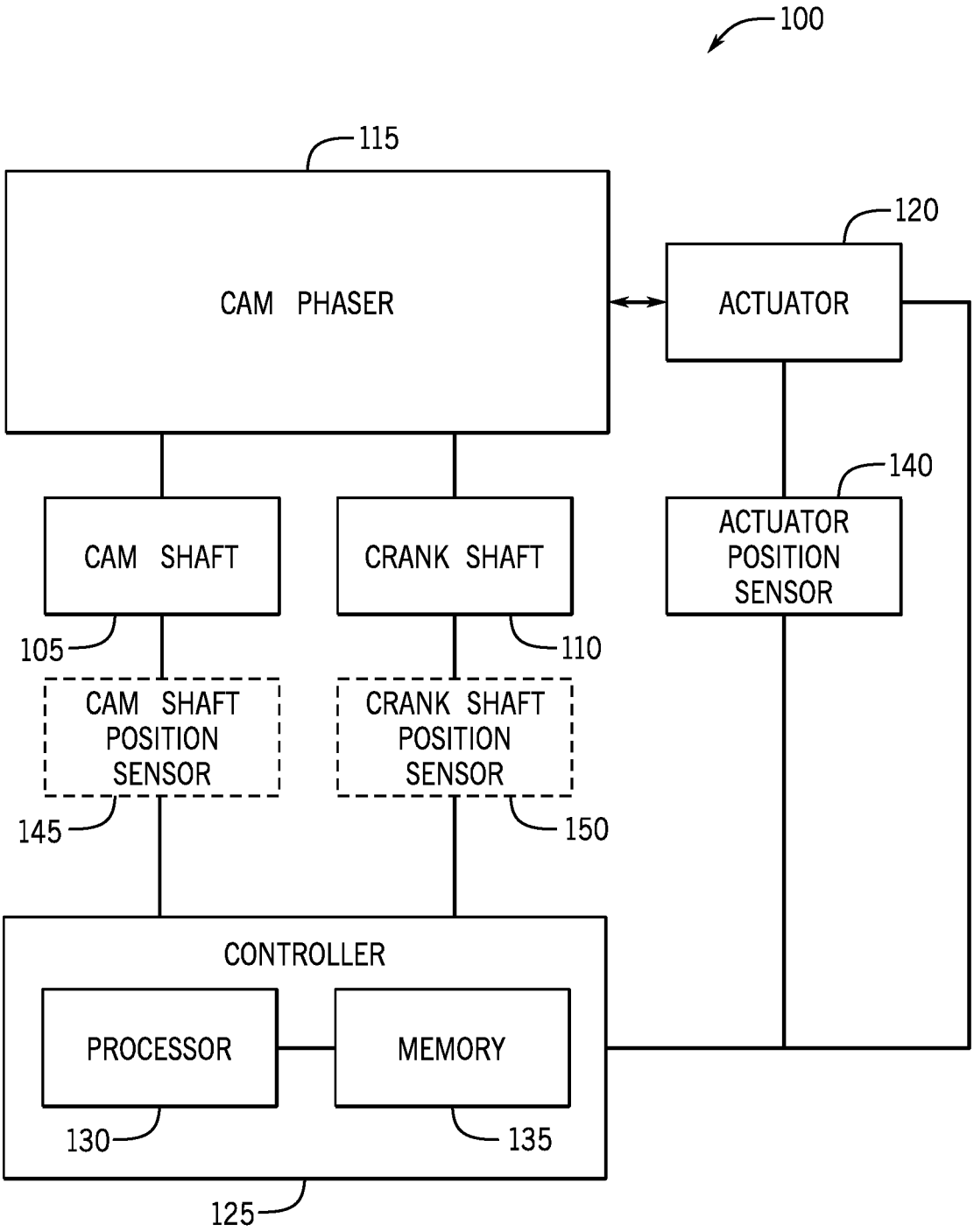
FIG. 1 is a diagrammatic view of a cam phasing system according to aspects of the present disclosure.

The following discussion is presented to enable a person skilled in the art to make and use embodiments of the invention. Given the benefit of this disclosure, various modifications to the illustrated embodiments will be readily apparent to those skilled in the art, and the principles herein can be applied to other embodiments and applications without departing from embodiments of the invention. Thus, embodiments of the invention are not intended to be limited to embodiments shown but are to be accorded the widest scope consistent with the principles and features disclosed herein.

The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

According to aspects of the disclosure, an actuator can be operated to control relative rotation between a first rotary component and a second rotary component. For example, in the context of an internal combustion engine, an actuator can be operatively coupled to a cam phaser arranged between a crank shaft and a cam shaft. The actuator can be operated by a controller (e.g., an electronic controller to control a phase angle between the crank shaft and the cam shaft. For example, the controller can operate the actuator to advance or retard cam timing, as well as to maintain cam timing during steady state, or near steady state operation. As generally described herein, the controller can be configured to operate the actuator during steady state or other phasing operations to account for hysteresis in the phasing system (e.g., due tolerances within the phasing system), which may result in the phase angle drift due to engine bias. Correspondingly, the controller can control the actuator position to maintain a desired phase angle and accommodate for system hysteresis. Additionally, the controller may be able to adjust for changes in hysteresis over time, for example, due to part wear. Further, the system may be configured to monitor wear over time and can provide an indication that the phasing system needs maintenance or replacement.

FIG. 1 shows a system 100 (e.g., a cam phasing system) configured to control the phase angle of a cam shaft 105 (e.g., a first rotary component) relative to a crank shaft 110 (e.g., a second rotary component). The system 100 can include a cam phaser 115 coupled between the cam shaft 105 and the crank shaft 110 of an internal combustion engine. The system 100 can include an actuator 120 configured to engage the cam phaser 115 to adjust a rotational position of cam phaser 115 (e.g., to control a phase angle between the cam shaft 105 and the crank shaft 110). The actuator 120 can be configured to provide an axial or rotational input to the cam phaser 115. For example, the actuator 120 can be a linear actuator or solenoid configured to axially displace in response to electrical current. The actuator 120 can also be a mechanical linkage, a hydraulically actuated actuation element, or other mechanism capable of providing an axial force and/or displacement to the cam phaser 115 According to another example, the actuator 120 can be a rotary actuator and may include a stator and a rotor that is electromagnetically coupled to the stator. A current may be applied to the rotary actuator that may result in a rotary output being provided by the rotary actuator in a desired direction at a desired force. In some non-limiting examples, the rotary actuator may be in the form of a brushless DC (BLDC) motor.

The system 100 can include a controller 125 configured to operate the actuator 120 to control the phase angle. The controller 125 can include a processor 130 and a memory 135. The memory 135 can be a non-transitory computer readable medium or other form of storage, such as flash or other type of memory, containing programs, software, or instructions executable by the processor 130. According to some non-limiting examples, the controller 125 can be integrated into an engine control unit (ECU) of the internal combustion engine. In other non-limiting examples, the controller 125 can be separate from the engine control unit. For example, the controller 125 can be integrated into a body of the actuator 120.

In the illustrated non-limiting example, the controller 125 can be in electrical communication with the actuator 120 to supply actuation command signals to the actuator 120. The controller 125 can also be in electrical communication with an actuator position sensor 140 configured to detect and determine an actuation position of the actuator 120. According to some non-limiting examples, the controller 125 can also be in electrical communication with a cam shaft position sensor 145 and a crank shaft position sensor 150 configured to determine and detect the rotational position of the cam shaft 105 and the crank shaft 110, respectively. In some cases, cam shaft and crank shaft speeds and accelerations can be derived from the cam shaft position sensor 145 and the crank shaft position sensor 150. In another example, data from the cam shaft position sensor 145 and crank shaft position sensor 150 is sent to the Engine Control Unit (ECU) prior to being sent to the controller 125. In one particular example, the cam/crank data send from the ECU to the controller 125 may be replicated cam/crank data from the cam/crank sensors 145, 150.

Figure 2:
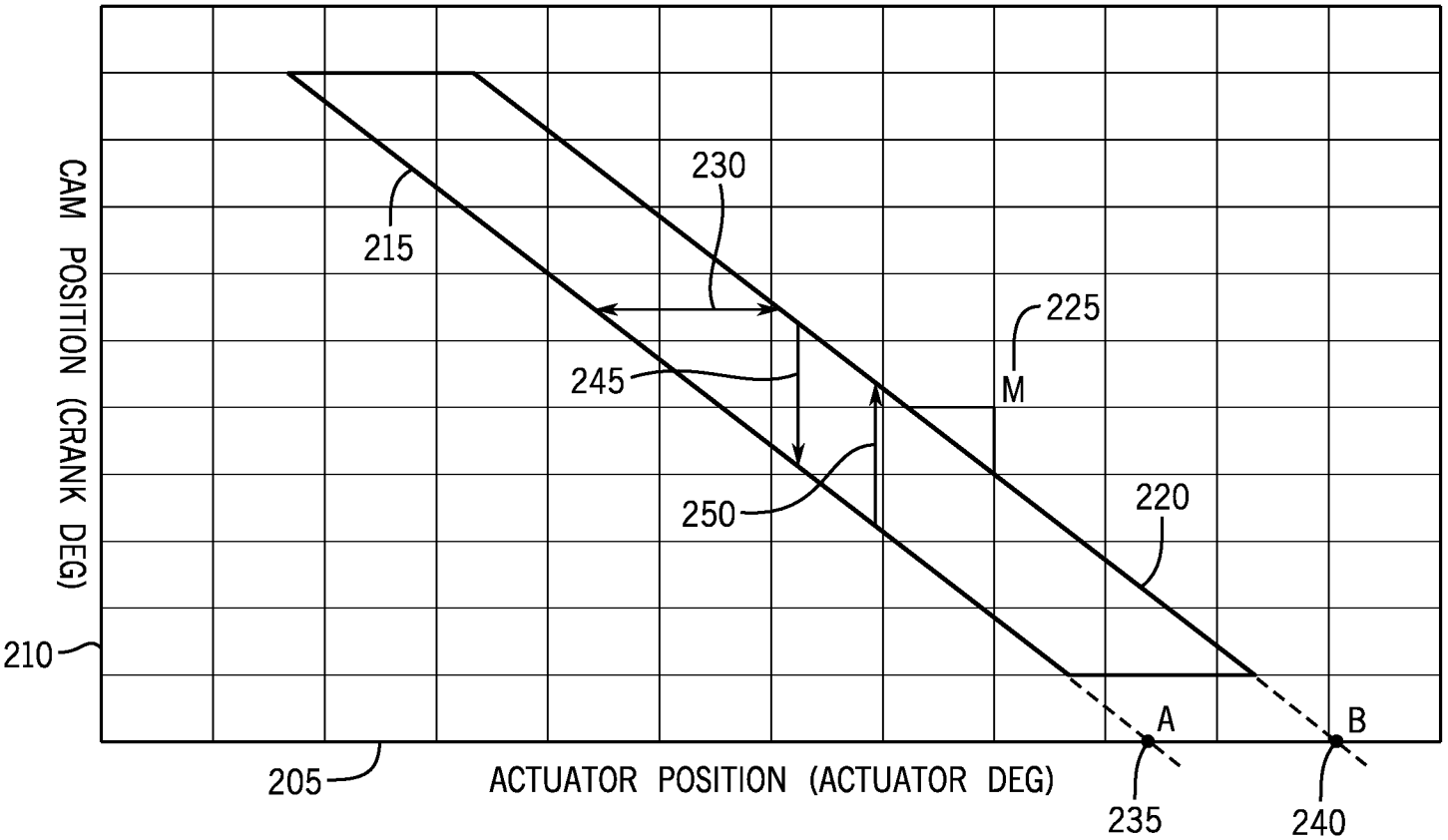
FIG. 2 is a graph showing a hysteresis band of the cam phasing system of FIG. 1.

FIG. 2 shows a graph having an x-axis 205 corresponding to a position of the actuator 120 (e.g., an angular or other position) and a y-axis 210 corresponding to a position of the cam shaft 105 (e.g., an angular or other position) based on a predetermined relationship between the cam shaft 105 and the cam phaser 115. The graph defines a retard-side boundary 215 (e.g., a first static boundary) that is parallel with an advance-side boundary 220 (e.g., a second static boundary). The position of the retard-side boundary 215 and the advance-side boundary 220 are determined by the mechanical arrangement of the cam phaser 115 and define where movement of the cam shaft 105 can be controlled by the actuator 120. Correspondingly, the retard-side boundary 215 is offset from the advance-side boundary 220 and corresponds with the edges of a hysteresis band 230 therebetween. The hysteresis band 230 is a region where movement of the actuator 120 may not result in a corresponding or known movement between the cam shaft 105 and the crank shaft 110. For example, gear play or other tolerances in the cam phaser 115 can contribute to the hysteresis band 230. Correspondingly, movement of the cam shaft 105 may only be effectuated by the actuator 120 when the position of the actuator 120 and the position of the cam shaft 105 are such that an operating point or hysteresis position is along one of the retard-side boundary 215 and the advance-side boundary 220. In one example, the operating point or hysteresis position may be calculated by the equation $HI_{SA}-A_P-(P_P*\text{Gear Ratio})$ where $HI_{SA}$ is the static advance hysteresis intercept, $A_P$ is the actuator position, $P_P$ is the phaser position, and Gear Ratio is the gear ratio within the system. As such, the actuator 120 must be operated so that the operating point is along the retard-side boundary 215 to retard timing, and the actuator 120 must be operated so that the operating point is along the advance-side boundary 220 to advance timing. In a similar vein, the actuator 120 must be along one of the retard-side boundary 215 and the advance-side boundary 220 to hold the cam phaser 115 at a desired phase angle, such as for steady state operation.

In one example, the retard-side boundary 215 and the advance-side boundary 220 may be calculated via the controller 125 and may be based on the predetermined relationship between the cam shaft 105 and the actuator 120 (e.g., a gear ratio therebetween). Particularly, a relationship may be between the cam shaft position and the actuator position.

For example, the controller 125 may calculate the retard-side boundary 215 and the advance-side boundary 220 from one or more data points (e.g., coordinates corresponding to actuator position versus cam position). The controller 125 may then utilize a known slope 225 to find the retard-side x-intercept 235 and the advance-side x-intercept 240. In one example, the slope 225 of the retard-side boundary 215 and the advance-side boundary 220 may be defined by a gear ratio of the system 100. In one example, the system 100 may include bias (e.g., retard bias 250 or advance bias 245) configured to bias the system towards either the retard hysteresis side or the advance hysteresis side of the hysteresis band 230 (e.g., along the y-direction in FIG. 2). The bias can result from various engine dynamics or mechanical means incorporated into the phaser design.

Figure 3:
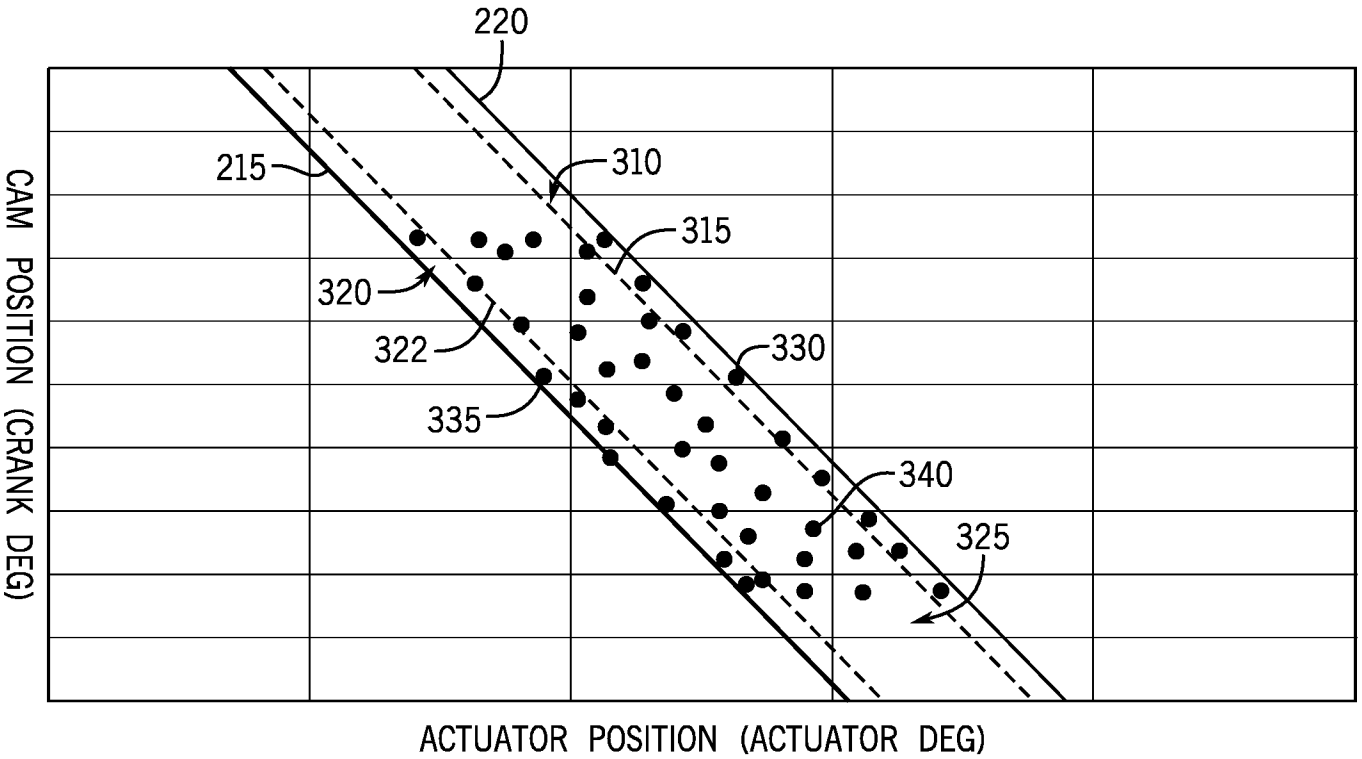
FIG. 3 is a graph showing another view of the hysteresis band of FIG. 2.

FIG. 3 shows various operating points (e.g., operating points 330, 335, 340) corresponding to positions of the actuator 120 with respect to the cam shaft 105. As described previously, the controller 125 may reference these points to assign "edges" to the hysteresis band 230. In one example, the system 100 may only be driven when the actuator 120 is within a predetermined threshold region of either the advance-side boundary 220 or the retard-side boundary 215. For example, the cam phasing system may be driven in the retard direction when the actuator position versus cam position operating point is within a retard region 320 (e.g., a threshold or first threshold distance). The retard region 320 is the area defined between the retard-side boundary 215 and a retard-side threshold boundary 322, which may be at a predetermined offset from the retard-side boundary 215. Correspondingly, the system 100 may be driven in the advance direction when the actuator position is within an advance region 310 (e.g., a threshold or first threshold distance). The advance region 310 is the area defined between the advance-side boundary 220 and an advance-side threshold boundary 315, which may be at a predetermined offset from the advance-side boundary 220.

The area between the advance region 310 and the retard region 320 may be a dead band 325 in which the system 100 must first drive the actuator (e.g., horizontal movement on graph) into either the advance region 310 or the retard region 320 prior to eliciting movement of the cam shaft 105. For example, point 330 is within the advance region 310 and thus may be driven in an advance direction (e.g., a first rotational direction), but not in a retard direction (e.g., a second rotational direction), without crossing the dead band 325. Correspondingly, an operating point 335 is within the retard region 320 and thus may be driven in the retard direction, but not in an advance direction, without crossing the dead band 325. Similarly, an operating point 340 is within the dead band 325 and thus must be driven to either the advance region 310 or the retard region 320 prior to driving the system 100 in either the advance or retard direction.

Figure 4:
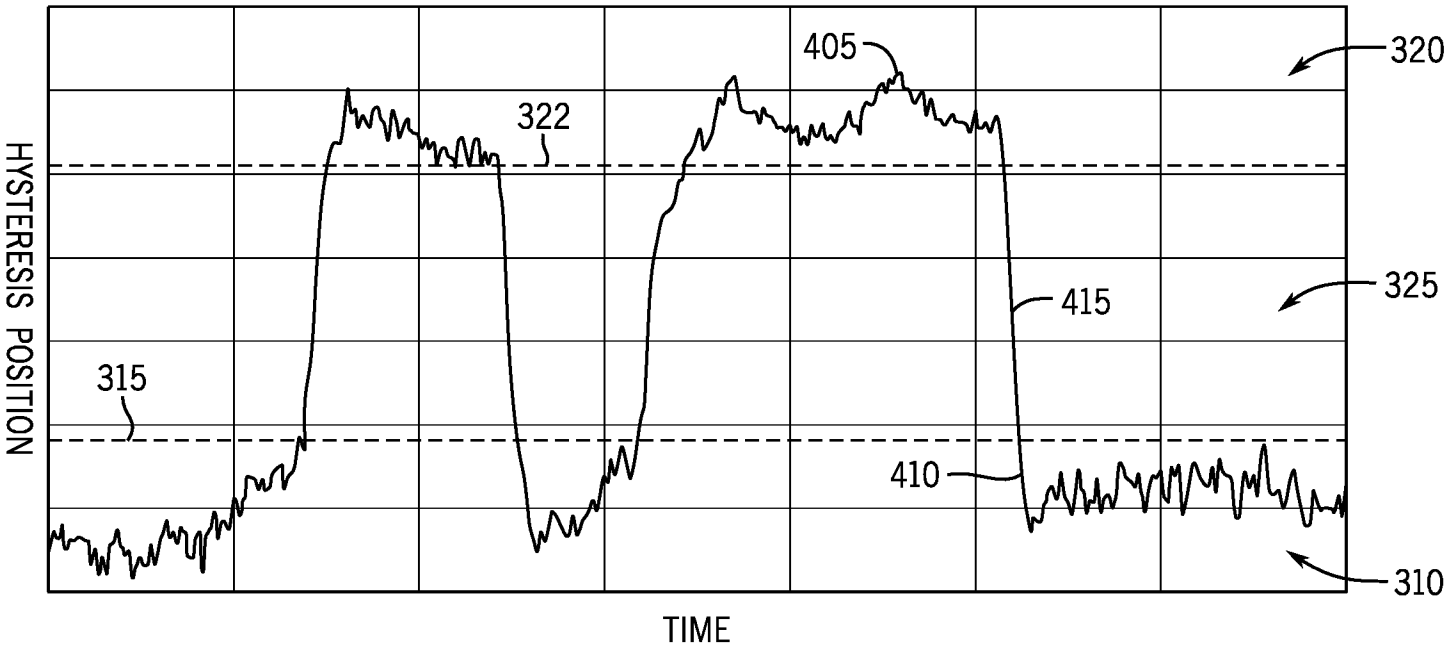
FIG. 4 is a graph showing operation of the cam phasing system of FIG. 1 in a steady state position.

Looking to FIG. 4, an example of the system 100 in a steady state (e.g., when no movement of the cam shaft 105 is desired) is shown. Looking at line 405, during this time, the actuator 120 is positioned within the retard region 320 and maintaining position of the cam shaft 105. However, due to bias (e.g., advance bias 245 or retard bias 250) the cam shaft 105 may begin to drift toward and into the dead band 325. To prevent unwanted movement of the cam shaft 105 into the dead band 325 (e.g., drift in the phase angle), the controller 125 can be configured to command the actuator 120 to move rapidly (e.g., complete a "strong action") to cross the dead band 325 and into one of the advance region 310 and the retard region 320. For example, the controller 125 can command the actuator 120 to move at a high angular speed (e.g., high revolutions per minute (RPMs)) to cross the dead band. This rapid movement of the actuator 120 is represented by line 415. Once the actuator 120 has crossed the dead band 325 and is within the advance region 310 as shown by line 410, the actuator 120 is able to continue to maintain the position of the cam shaft 105 (e.g., hold the system 100 at steady state). Similar principles apply when maintaining the position of the cam shaft 105 with the operating position in the retard region, such that actuator 120 may cross the dead band 325 if the operating position drifts towards the dead band 325.

Figure 5:
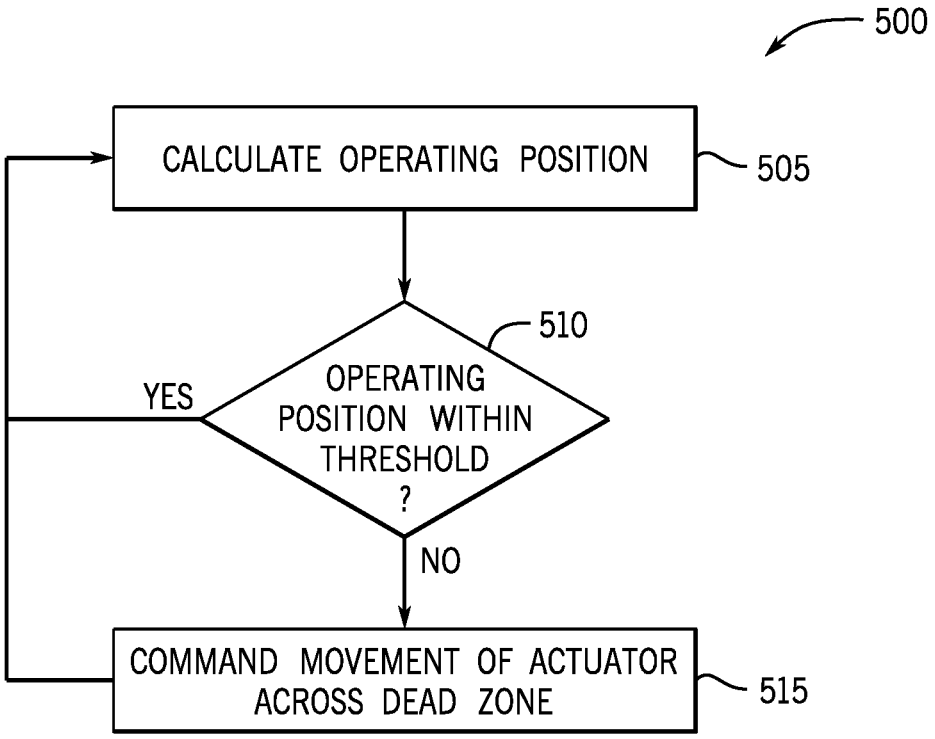
FIG. 5 is a flowchart of an actuation process for the cam phasing system of FIG. 1.

FIG. 5 shows a flowchart 500 describing the process illustrated in FIG. 4. For example, at stage 505 the controller 125 may calculate the current operating position (e.g., the position of the system 100 with respect to the advance region 310, retard region 320, or dead band 325). At stage 510, if the position of the system 100 is within the advance region 310 or the retard region 320 no action is taken. However, if the position of the system 100 is outside of the advance region 310 or the retard region 320, or substantially close to crossing into the dead band 325, the controller 125 can be configured to command the actuator 120 to conduct a strong action and cross the dead band 325 into the other of the advance region 310 or the retard region 320 at stage 515. For example, if the system 100 was within the advance region 310 and was approaching the dead band 325, the controller 125 may command the actuator to strong action into the retard region 320 to maintain the steady state position of the system 100, and vice versa.

Figure 6:
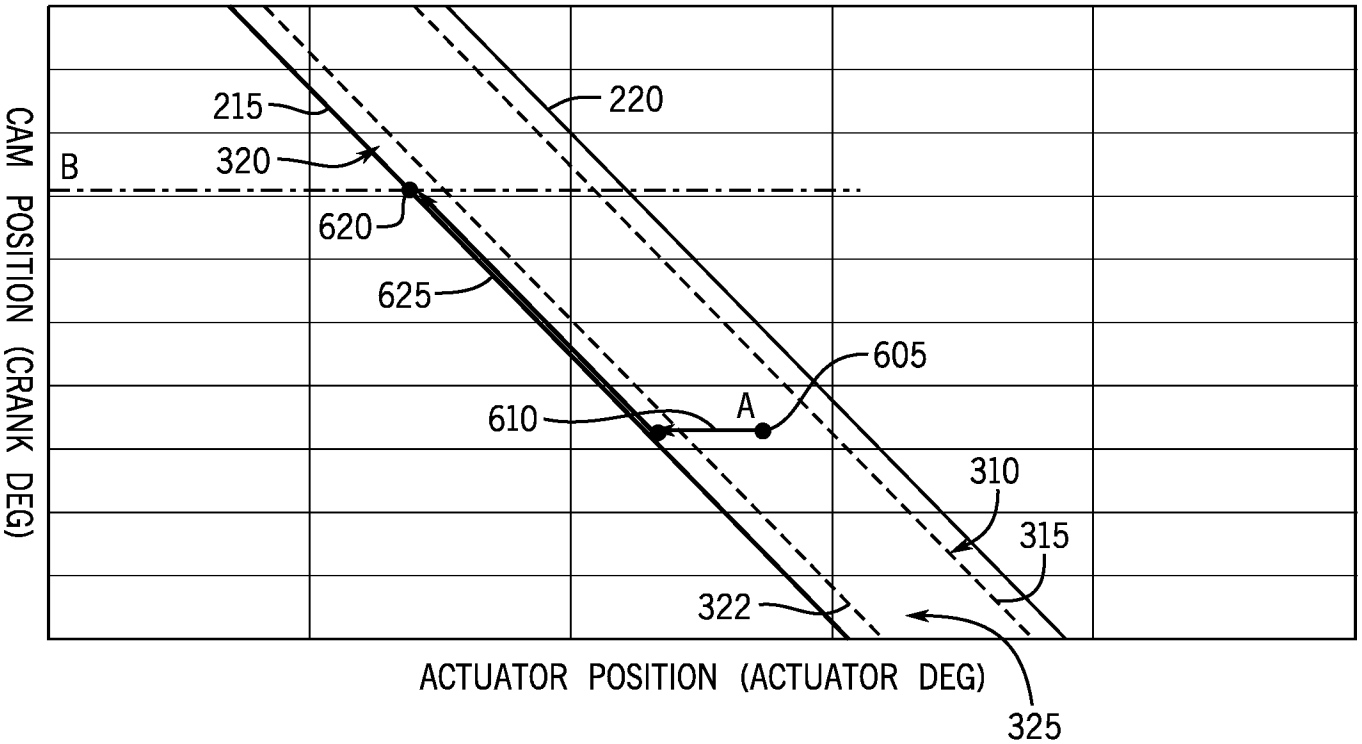
FIG. 6 is a graph showing a phasing operation of the cam phasing system of FIG. 1.

As shown, when the actuator 120 is within the dead band 325, the actuator 120 must first move to either the advance region 310 or the retard region 320, to move the cam shaft 105 to either advance or retard cam timing (e.g., to induce a change in phase angle). For example, FIG. 6 shows an example graphical representation of movement of the cam shaft 105 from a first position 605 to a second position 620. For example, the actuator 120 may be driven by the controller 125 to move the actuator 120 from the first position 605 toward the retard-side boundary 215 (shown via arrow 610) to enable the actuator 120 to move the cam shaft 105 to adjust the phase angle (e.g., to retard cam timing). Once the actuator 120 reaches the retard-side boundary 215, continued operation of the actuator 120 may facilitate movement of the cam shaft 105 (shown via arrow 615) to the second position 620. Similarly, looking now to FIG. 7, another example graphical representation of movement of the cam shaft 105 from a first position 705 to a second position 720 is shown. In this case, the actuator 120 is within the retard region 320, so the actuator 120 must first cross from the retard-side boundary 215, through the dead band 325, to the advance-side boundary 220, as shown by arrow 710. Once the actuator 120 is on the advance-side boundary 220, the actuator 120 may continue to drive the cam shaft 105 to the second position 720, as shown by arrow 715, to advance cam timing.

Figure 7:
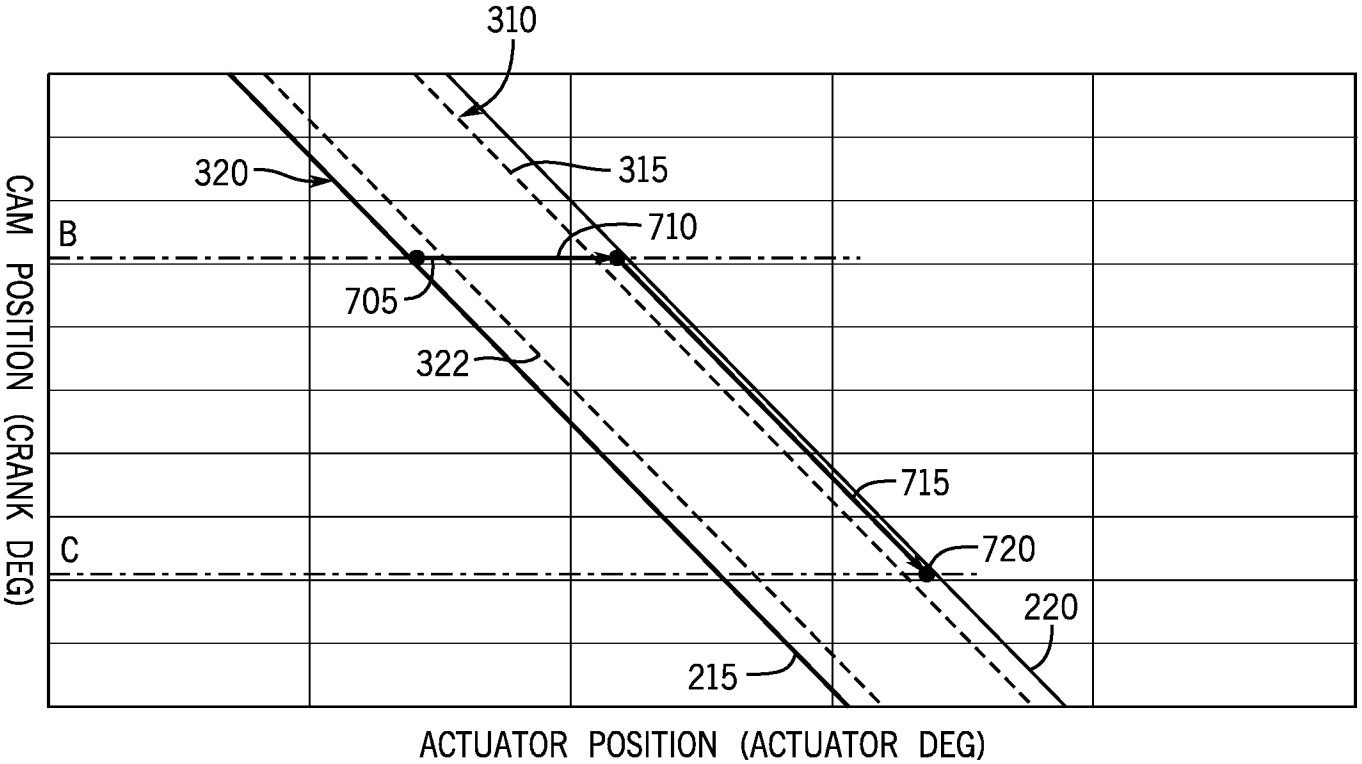
FIG. 7 is a graph showing another phasing operation of the cam phasing system of FIG. 1.
Figure 8:
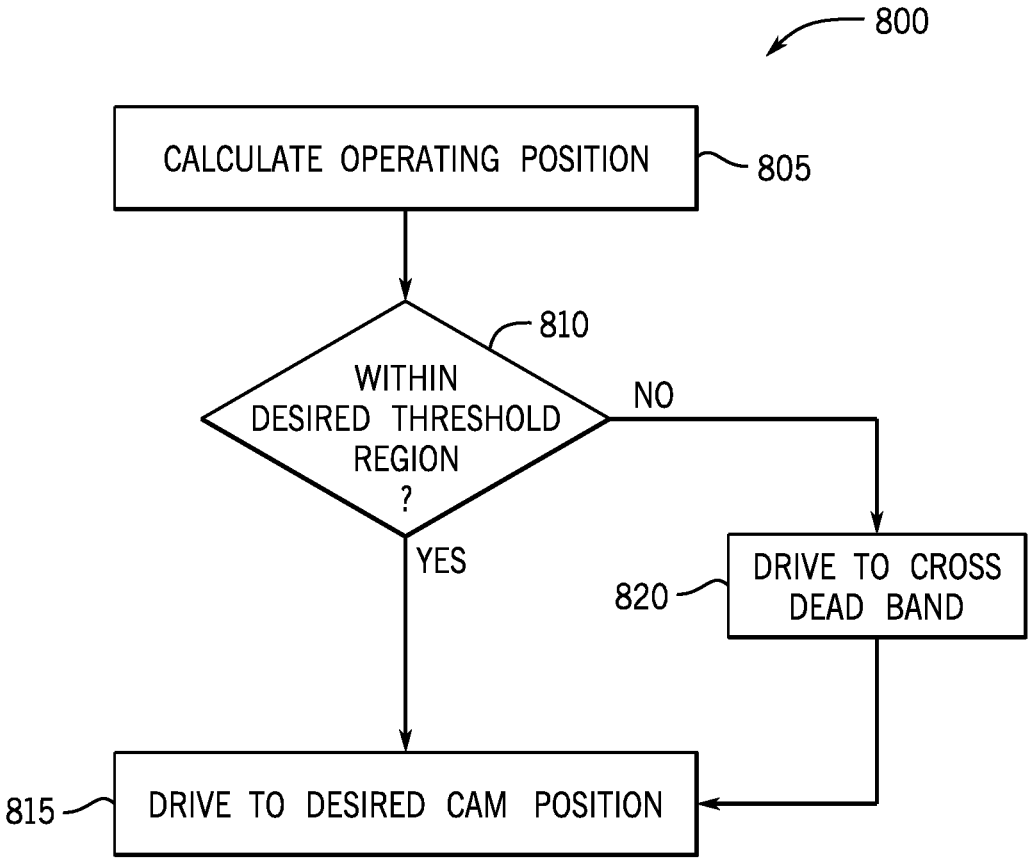
FIG. 8 is a flowchart of another example of the actuation process of the cam phasing system of FIG. 1.
Figure 9:
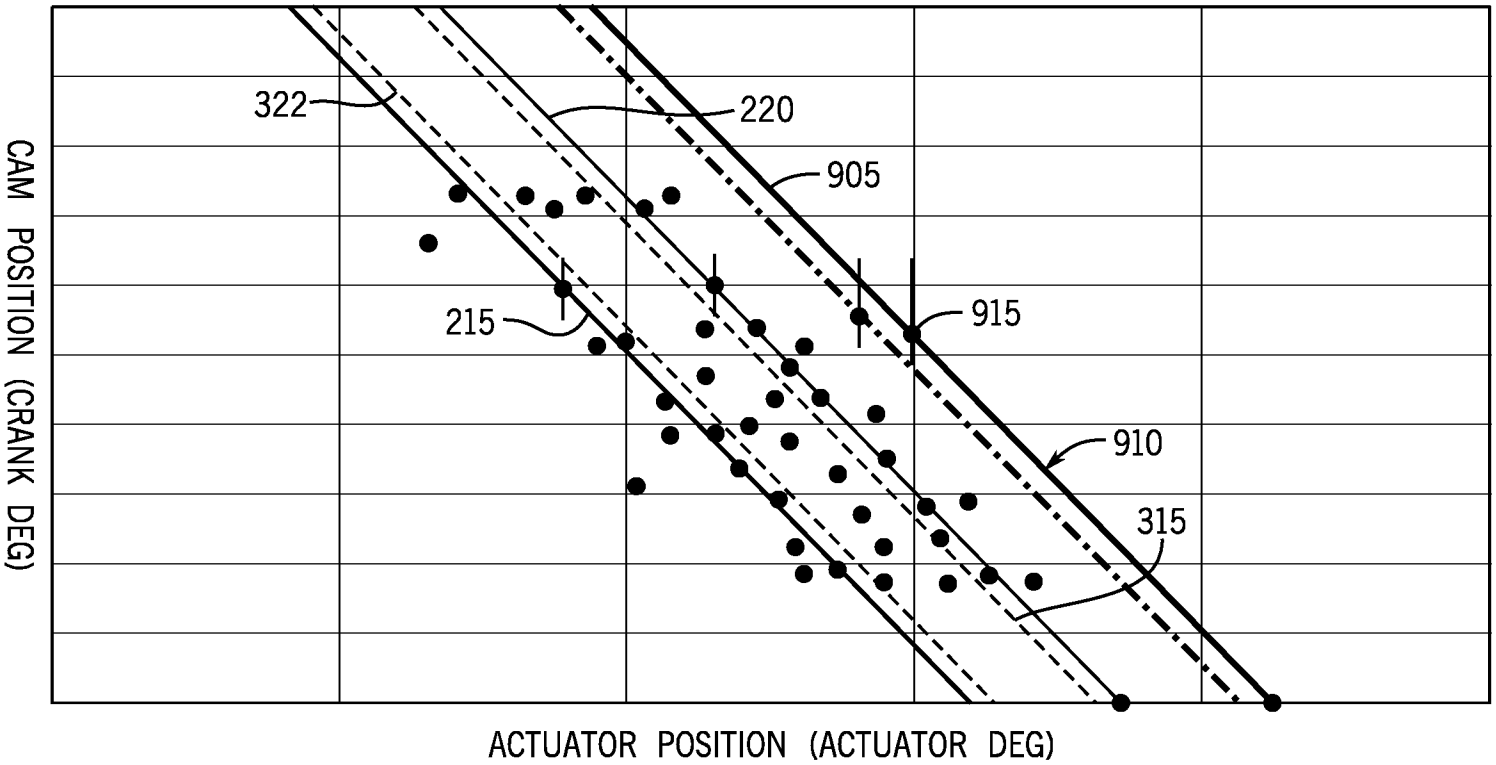
FIG. 9 is a graph showing an example of dynamic hysteresis in the cam phasing system of FIG. 1.

FIG. 8 shows a flowchart 800 describing the processes illustrated in FIGS. 6 and 7. For example, at stage 805, the controller 125 may calculate the operating position (e.g., the position of the actuator 120 with respect to the cam shaft 105). At stage 810, the controller 125 may determine whether or not the system 100 is within the threshold region for actuation of the cam shaft 105 (e.g., the advance region 310 or the retard region 320). For example, the controller 125 may determine if the actuator 120 is within the retard region 320 such that the actuator 120 can move the cam shaft 105 to change the phase angle to retard cam timing. Correspondingly, the controller 125 may determine if the actuator 120 is with the advance region 310 such that the actuator 120 can move the cam shaft 105 to change the phase angle to advance cam timing. At stage 815, if the actuator is within a desired threshold region (e.g., in advance region 310 if advance movement of the cam shaft 105 is desired), the controller 125 can command the actuator 120 to move the cam shaft 105 to the desired position. However, at stage 820, if the actuator 120 is not within the desired threshold region, the controller 125 can command the actuator 120 to move into the desired threshold region (e.g., into either the advance region 310 or the retard region 320 depending on desired movement of the cam shaft 105). Once in the desired threshold region, the controller 125 can continue to command the actuator 120 to drive the cam shaft 105 into the desired position at stage 815.

FIGS. 9 and 10A-C graphically illustrate a process for determining the edge of the hysteresis band 230. For example, in practical application, the exact location of the retard-side boundary 215 and the advance-side boundary 220, and thus the hysteresis band 230 of the system 100, may change based on various factors (e.g., engine speed, load, variation in system components, etc.). Accordingly, to avoid overshooting the edge of the hysteresis band 230 and causing and undesired change in phase angle, which may require recrossing the hysteresis band 230 to correct, the controller 125 may dynamically adjust a local (e.g., local to advance/retard-side) dynamic hysteresis edge 905. For example, the dynamic hysteresis edge 905 may correspond to an operating point 915 that is different from the previously recorded hysteresis band 230. In one example, the dynamic hysteresis edge 905 may include a dynamic threshold region 910 similar to the advance region 310 and retard regions 320 described previously.

Figure 10A:
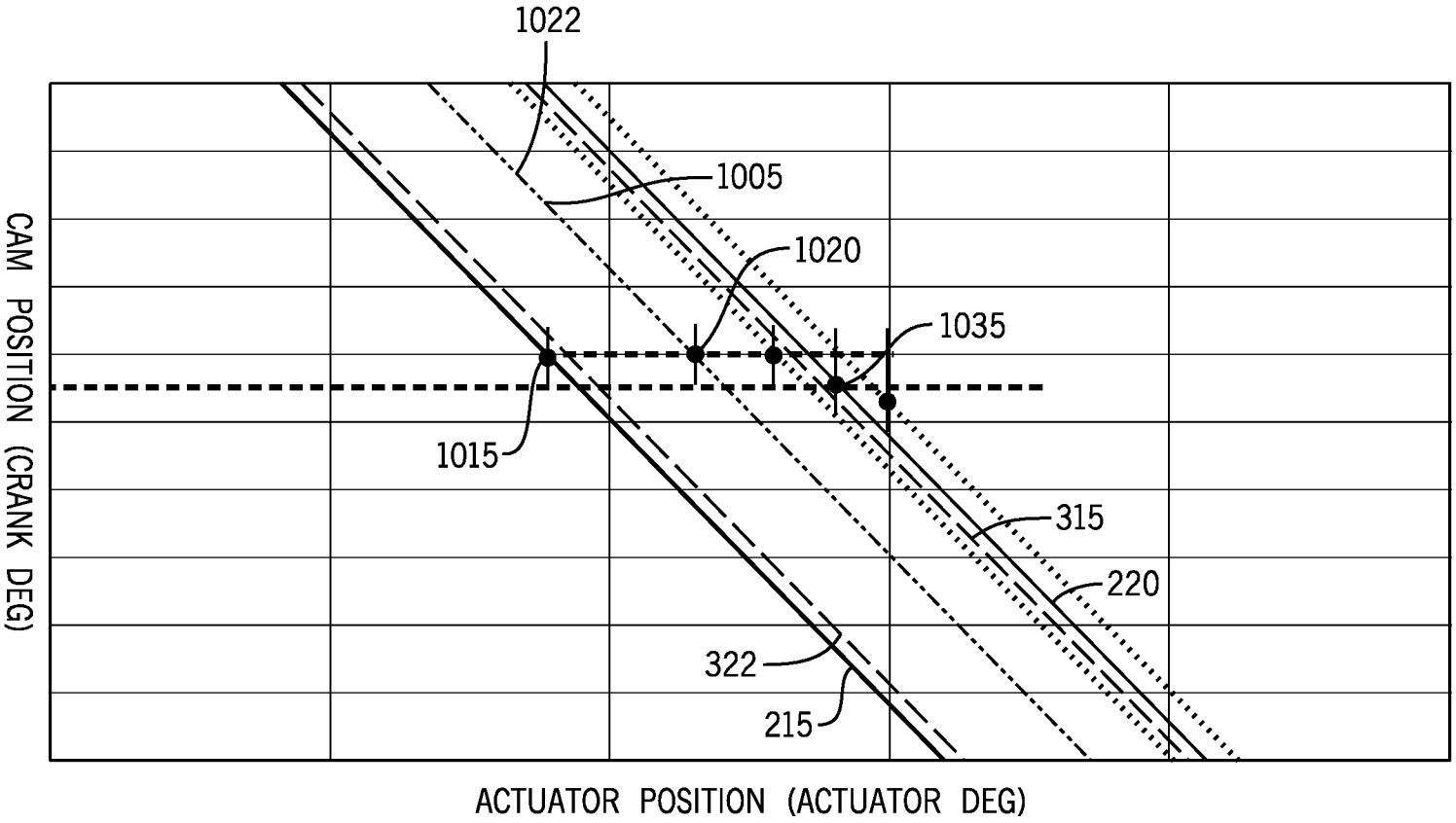
FIG. 10A-C are graphs showing an example phasing operation of the cam phasing system of FIG. 1.
Figure 10B:
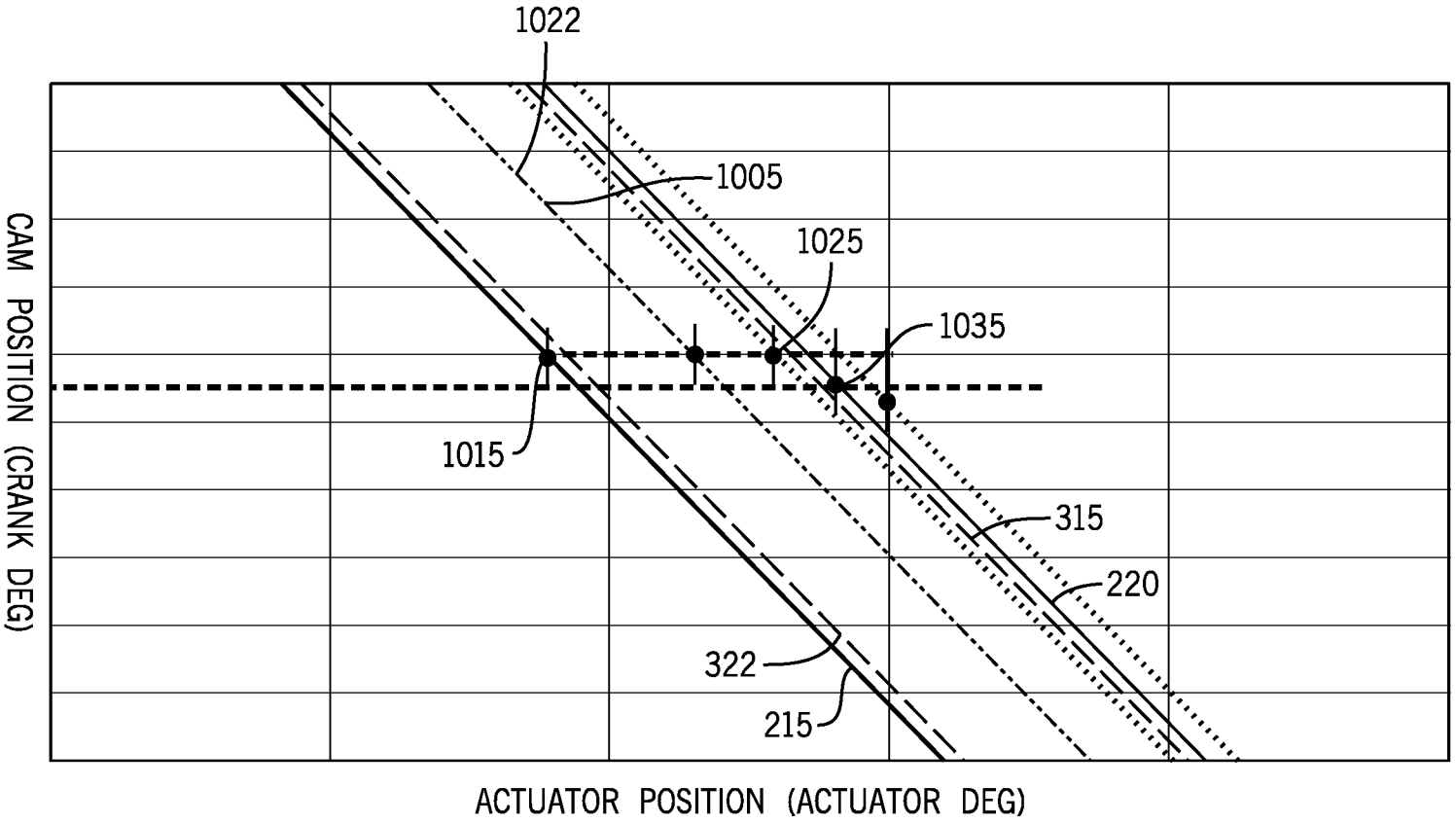
Figure 10C:
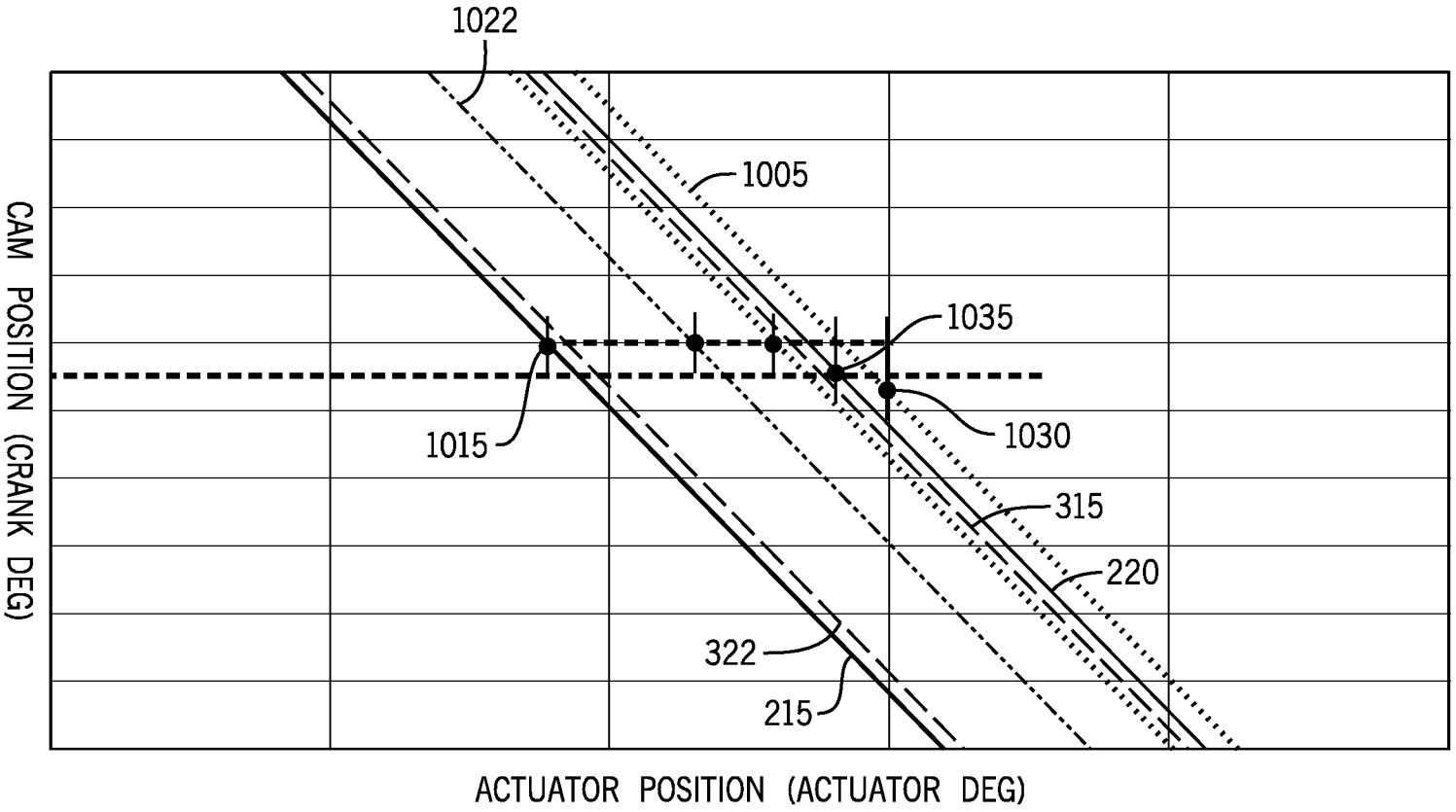
Figure 11:
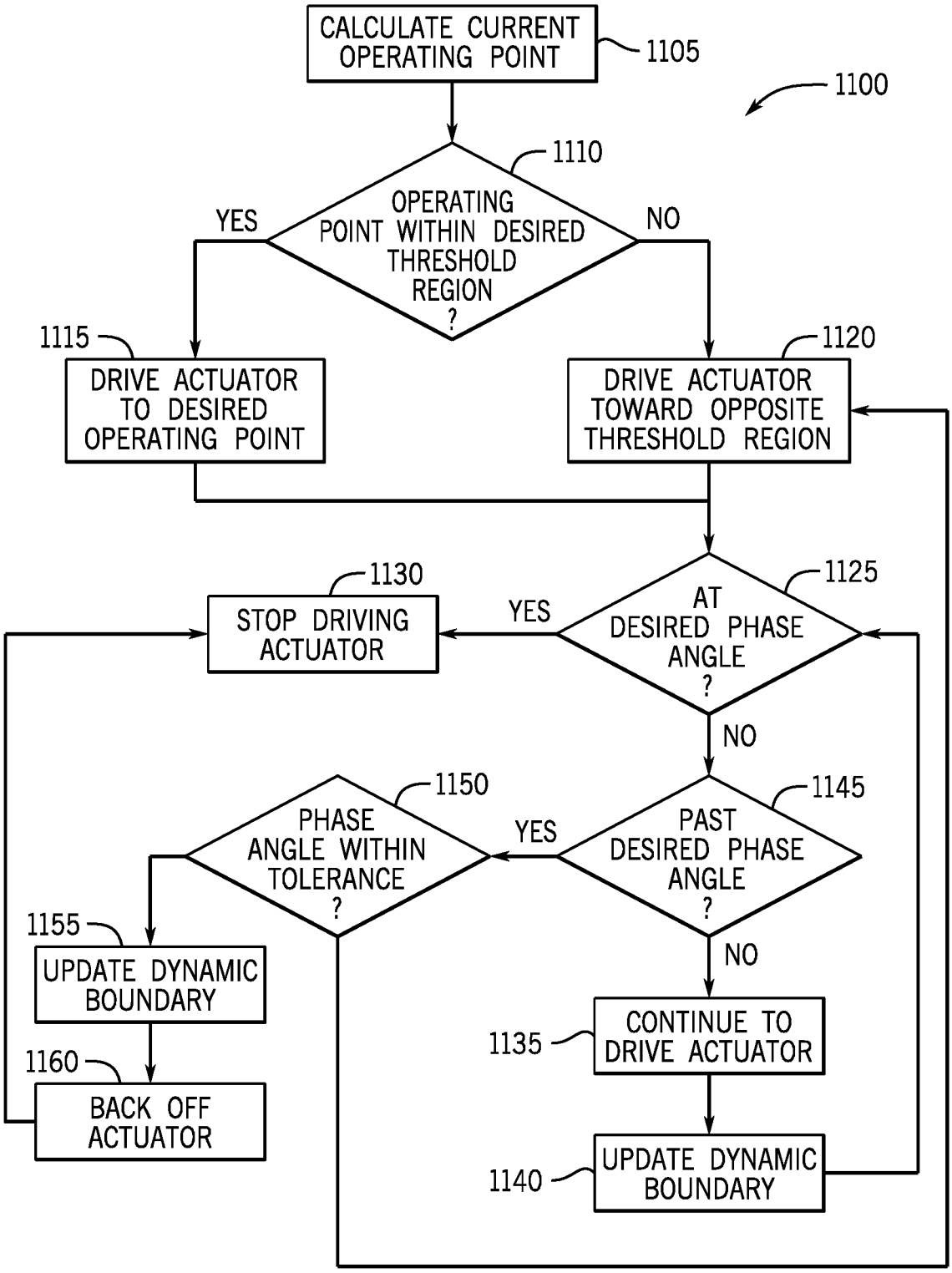
FIG. 11 is a flowchart of an example of the actuation process for the cam phasing system of FIG. 1.

FIG. 11 shows a flowchart of a processes 1100 illustrated in FIGS. 10A-C, which show a graphical representation of a phasing process to adjust the phase angle of the cam shaft 105 from a first, current operating point 1015 on the retard-side boundary 215 (e.g., corresponding to a first, current phase angle), to a second, desired operating point 1035 on the advance-side boundary 220 (e.g., corresponding to a second, desired phase angle). It is appreciated that similar principles apply when moving from the advance-side boundary 220 to the retard-side boundary 215 to adjust a phase angle, and when moving between the advance-side boundary 220 and the retard-side boundary 215 to maintain a desired phase angle during steady state operation. Moreover, it is appreciated that some of the stages of process 1100 may occur simultaneously and need not be carried out in the order described herein.

Operations can begin at stage 1105, where the controller 125 can calculate a current operating point 1015 (e.g., the position of the actuator 120 with respect to the cam shaft 105), and thus a phase angle of the cam shaft 105. At stage 1110 the controller 125 can determine whether the current operating point 1015 is in the desired threshold region (e.g., the retard region 320 or the advance region 310) to effectuate a desired movement of the cam shaft 105 to the desired operating point and phase angle. If the current operating point 1015 is in the desired threshold region, for example, if the phase angle of the cam shaft 105 is being adjusted to retard cam timing, the process 1100 can proceed to stage 1115 where the controller 125 can drive (e.g., command or otherwise operate) the actuator 120 toward the desired operating point to move the cam shaft 105 to the desired phase angle. If the current operating point 1015 is not in the desired threshold region, for example, with respect to FIG. 10A, if the phase angle of the cam shaft 105 is being adjusted to advance cam timing, the process 1100 can proceed to stage 1120 where the controller 125 can drive the actuator 120 into the dead band 325 (e.g., across the hysteresis band 230) via strong action toward the advance-side boundary 220. Specifically, the controller 125 can operate the actuator 120 to reach an operating point 1020 that is along a conservative boundary 1022. The conservative boundary 1022 can be at a predetermined offset from the advance-side boundary 220, which may be outside of the advance region 310 and in the dead band 325, so that overshoot can be avoided. The conservative boundary 1022 can also correspond with an initial position of a dynamic boundary 1005, which can be set and modified by the controller in accordance with an actual edge of the hysteresis band 230, as described in greater detail below.

Following movement at either stage 1115 or stage 1120, the controller can determine if the cam shaft 105 is at the desired phase angle. If the cam shaft 105 is at the desired phase angle, then the controller 125 can stop driving the actuator 120 at stage 1130. In some cases, the dynamic boundary can be removed from memory at stage 1130 when the system decides to cross the dead band 325 or when a large movement of the cam shaft is commanded. It is appreciated that the controller 125 may determine whether the cam shaft 105 is within a first predefined tolerance from the desired phase angle (e.g., a range less than within about two degrees, from the desired phase angle). If the cam shaft 105 is not at the desired phase angle, the controller 125 can determine if the cam shaft 105 has moved past the desired phase angle (e.g., to over-advance or over-retard cam timing), or if the cam shaft 105 has not yet reached the desired phase angle. For example, the controller 125 can determine if the cam shaft 105 is at the desired phase angle by comparing the desired phase angle with a measured phase angle (e.g., calculated from the cam shaft position sensor 145 and the crank shaft position sensor 150), or the phase angle corresponding to operating point 1020. If the cam shaft 105 has not yet reached the desired phase angle, the controller 125 can continue to drive the actuator 120 to move toward the desired operating point 1035 (e.g., toward the advance-side boundary 220), for example to reach operating point 1025 in FIG. 10B. The controller 125 can then update the dynamic boundary 1005 to correspond with operating point 1025 and then return to stage 1125.

If the cam shaft 105 has moved past the desired phase angle, for example, to reach operating point 1035 in FIG. 10C, the controller 125 can determine if the phase angle of the cam shaft 105 is within a second predefined tolerance from the desired phase angle, such that the natural bias of the engine may move the cam shaft 105 to the desired phase angle (e.g., the desired operating point 1035). If the phase angle is not within the second tolerance, the process 1100 can return to stage 1120. In this way, the controller 125 can drive the actuator 120 in the opposite direction to move the operating point back across the dead band 23 so the cam shaft 105 can be driven via the actuator 120 back toward the desired phase angle. However, if the phase angle is within the second tolerance, the controller 125 can update the dynamic boundary 1005 at stage 1155 and drive the actuator 120 in the opposite direction to back off the actuator 120 at stage 1160, which can allow the engine bias to cause the cam shaft 105 drift to the desired operating point 1035 to achieve the desired phase angle. The process 1100 can the proceed to stage 1130.

Figure 12:
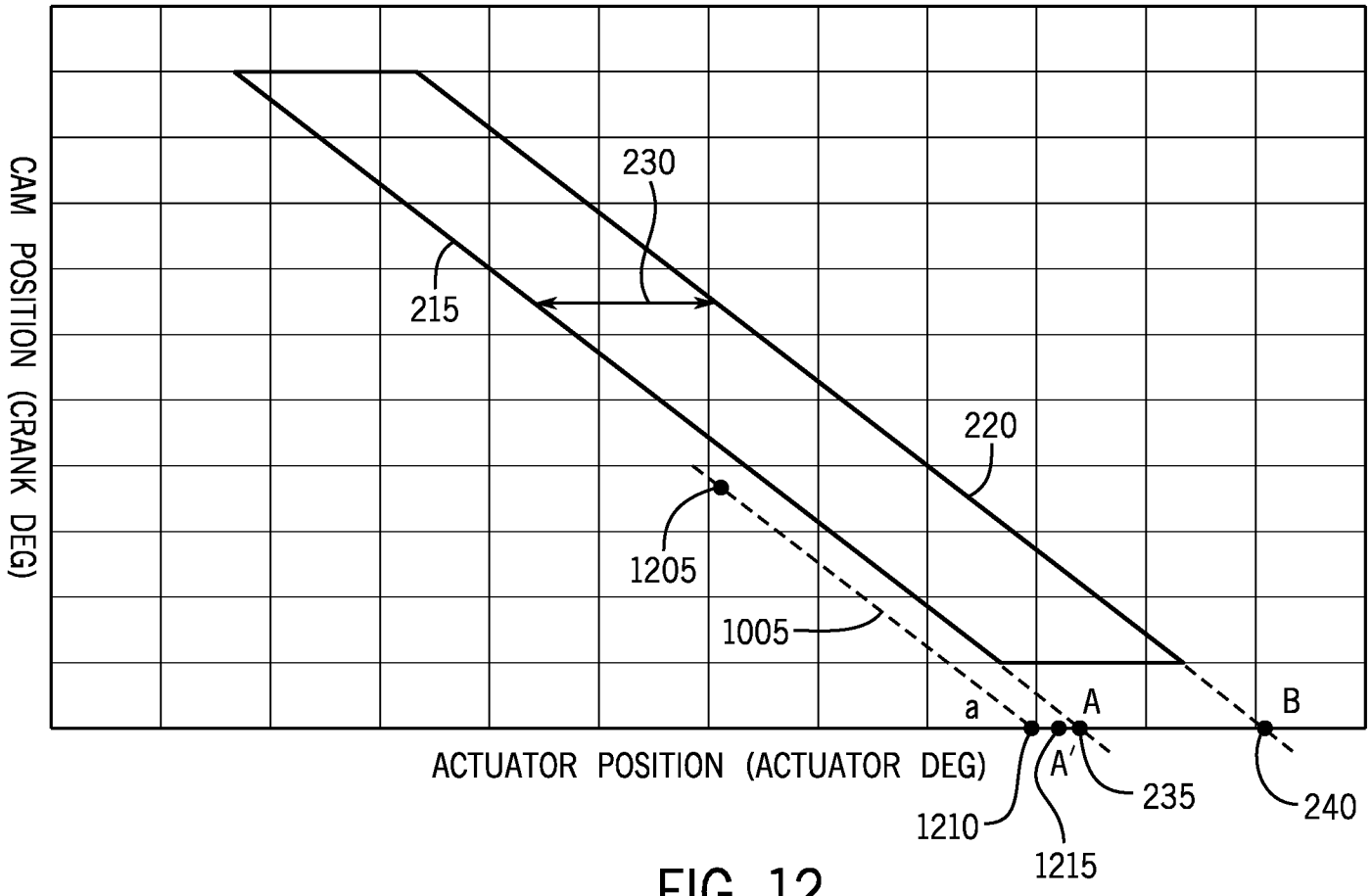
FIG. 12 is a graph showing an example of hysteresis learn of the cam phasing system of FIG. 1.
Figure 13:
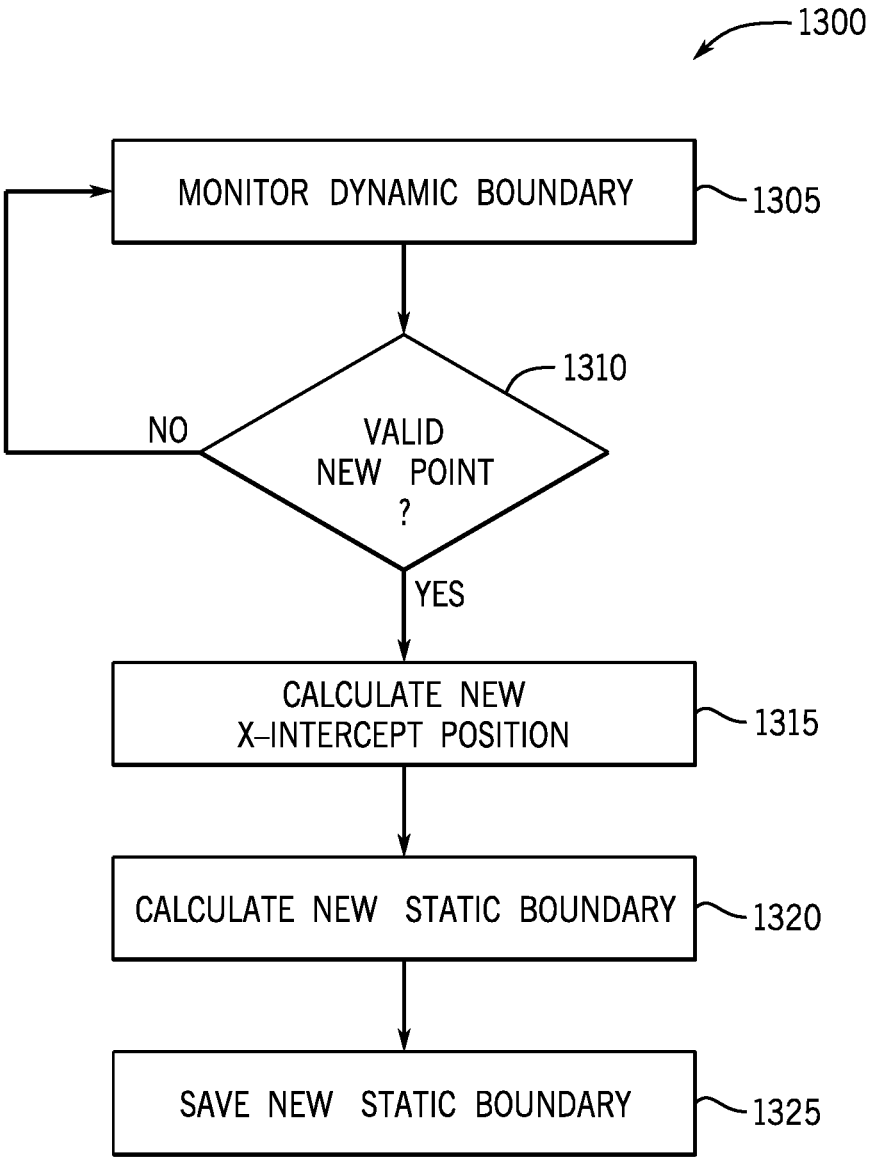
FIG. 13 is a flowchart of the hysteresis learn process of FIG. 12.

FIG. 13 shows a flowchart describing a processes 1300 illustrated in FIG. 12 for updating a dynamic boundary, such as the dynamic boundary 1005 (e.g., at stages 1140 and 1155). For example, at stage 1305, the controller 125 monitors the dynamic boundary 1005 as described previously. At stage 1310, the controller 125 determines whether or not the dynamic boundary 1005 corresponding to a current operating point 1205 (e.g., operating point 1025 or 1030) is valid or invalid based on various system conditions (e.g., engine speed, motor (i.e., actuator) speed, etc.). For example, high actuator speed may tend to distort the current operating point, which may lead to an invalid operating point. At stage 1315, if the operating point 1205 is valid, the controller 125 calculates an x-intercept 1210 corresponding to the operating point 1205 (e.g., via the known slope of the edges of the hysteresis band 230, i.e., the retard-side boundary 215 and the advance-side boundary 220). The controller 125 may then calculate a new static boundary 1215 (e.g., the retard-side boundary 215 or the advance-side boundary 220) at stage 1320. In some case, the controller 125 can be configured to update the new static boundary 1215 over time. For example, the controller 125 may calculate the new static boundary 1215 using the equation A'=A+/−(a−A)*Learn Rate, where A' is the new static boundary 1215, A is the prior static boundary (e.g., the current retard-side boundary 215 or the advance-side boundary 220), a is the x-intercept 1210 of the operating point 1205, and the Learn Rate is a scale factor. In some cases, the Learn Rate can be tuned to mitigate the effects of noise or errant readings on the system. At stage 1325, the controller 125 may save the new static boundary 1215 to the memory 135 (e.g., non-volatile memory) as the current retard-side boundary 215 or advance-side boundary 220. Correspondingly, the controller 125 may generate a new conservative boundary 1022, and a new advance-side threshold boundary 315 or retard-side threshold boundary 322, as a percentage or offset of the new static boundary 1215. As should be appreciated, the hysteresis band 230 may expand or shrink over time due to wear or other conditions between the actuator 120 and the cam shaft 105 or cam phaser 115.

Figure 14:
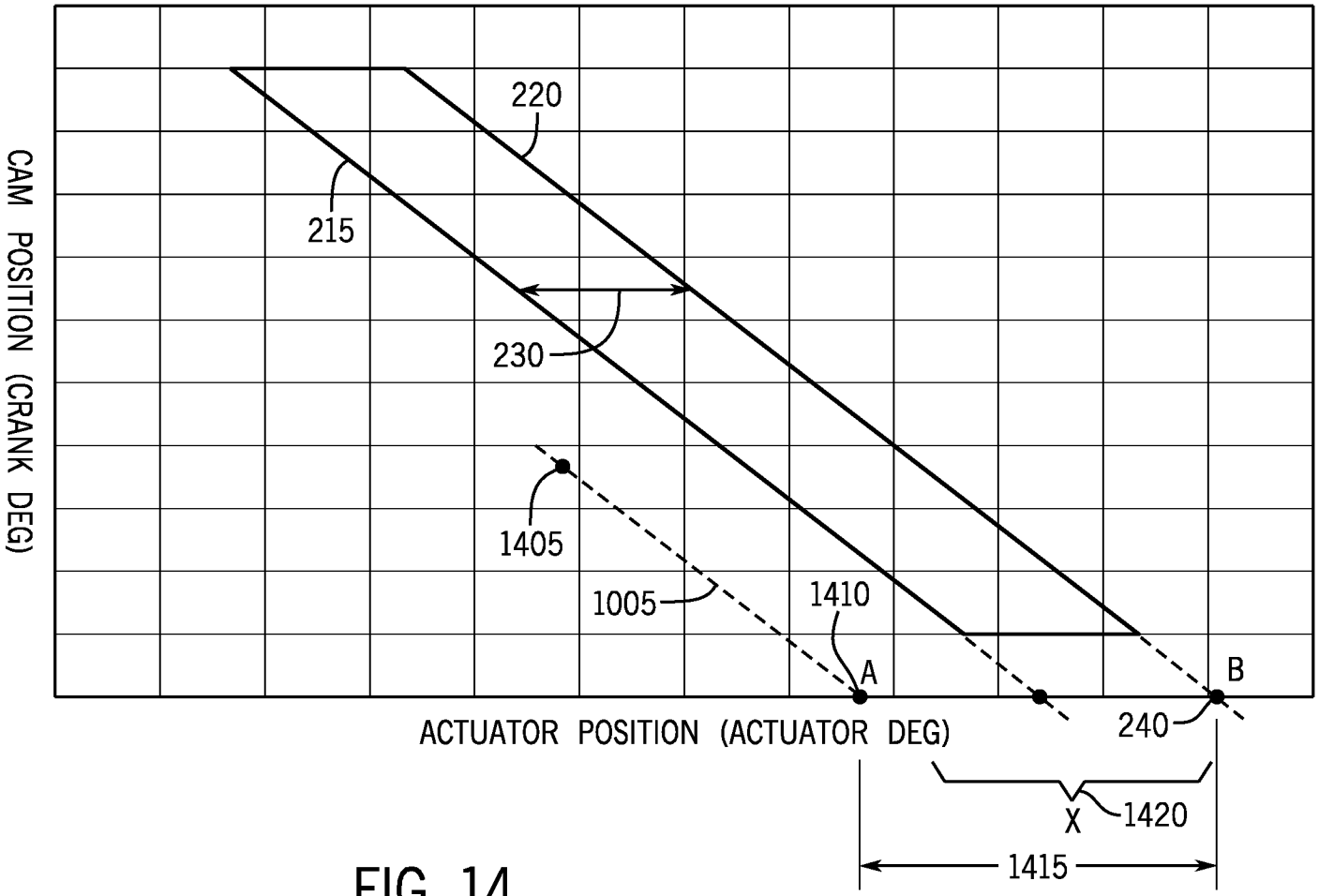
FIG. 14 is a graph showing a hysteresis threshold of the cam phasing system of FIG. 1.
Figure 15:
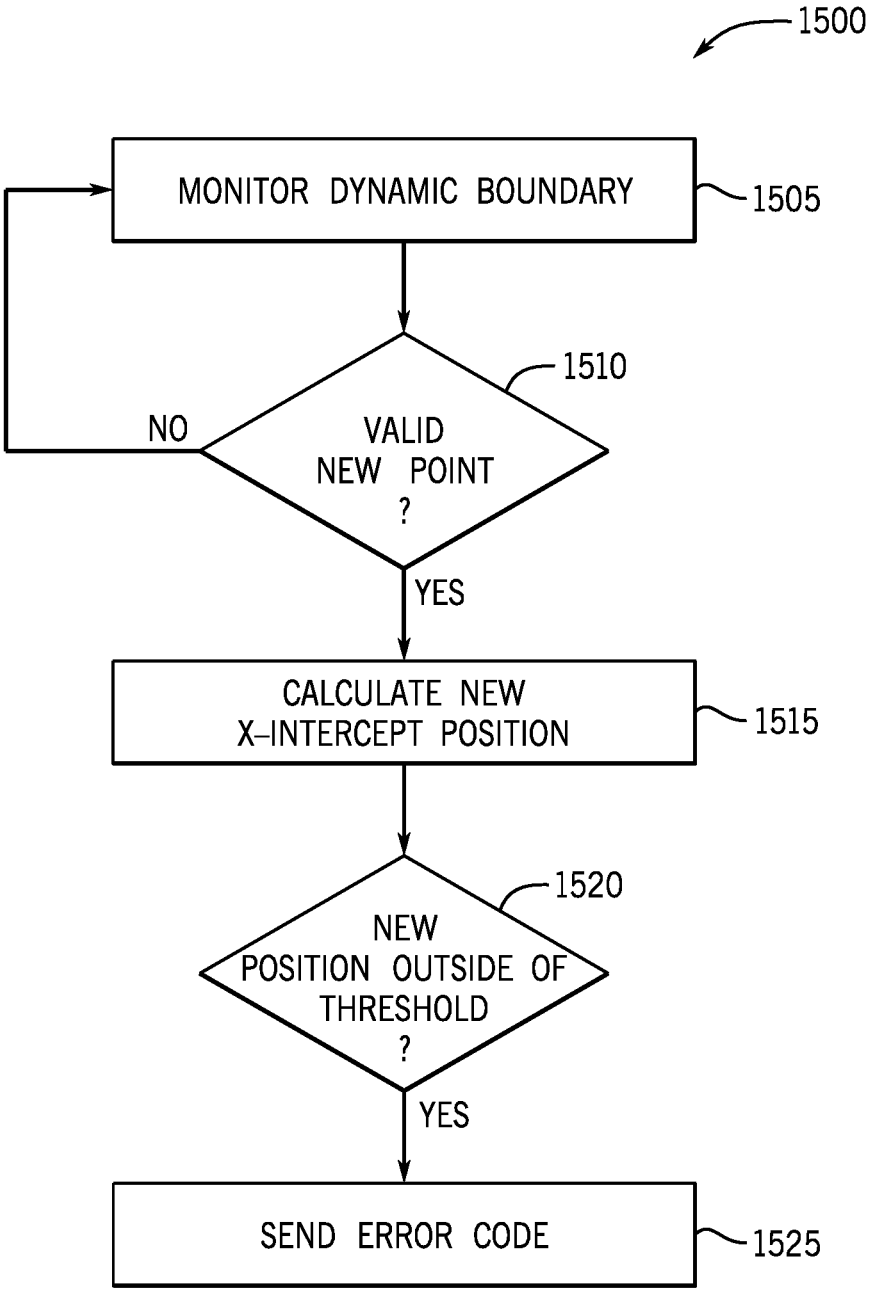
FIG. 15 is a flowchart of the hysteresis threshold tracking process of FIG. 14.

FIG. 15 shows a flowchart describing a processes 1500 illustrated in FIG. 14 for determining whether a hysteresis band is larger than a maximum permitted value, which may indicate excessive wear or other damage to a phasing system. For example, at stage 1505, the controller 125 can monitor the dynamic boundary 1005 as described previously. At stage 1510, the controller 125 determines whether or not the dynamic boundary 1005 corresponding to new operating point 1405 is valid or invalid based on various engine conditions (e.g., engine speed, motor speed, etc.). At stage 1515, if the new operating point 1405 is valid, the controller 125 can calculate an x-intercept 1410 corresponding to the new operating point 1405 (e.g., via the known slope). At stage 1520, the controller 125 determines whether or not the x-intercept 1410 is outside of a predetermined threshold distance 1420. For example, as shown in FIG. 14, where the dynamic boundary 1005 corresponds with the retard-side boundary 215, the controller 125 can determine whether a distance 1415 from the x-intercept 1410 to the advance-side x-intercept 240 (e.g., the x-intercept of the advance-side boundary 220) is larger than the predetermined threshold distance 1420. If no, the system can continue operating as normal. If yes, at stage 1525, the controller 125 can send an error code (e.g., a CAN message or other signal) indicating to an operator that excessive hysteresis is detected, which may be a result of wear within the system 100. It is appreciated that, the system 100 may continue operation concurrently with and after sending the error code. In another example, sending the error code may disable operation of the system 100. In another example, the processes of FIGS. 13 and 15 may be concurrent processes. For example, as the new static boundary is generated, the controller 125 compares the difference between the current advance and retard static boundaries vs. a predetermined threshold distance between the current advance and retard status boundaries. If the current distance is larger than the threshold distance, the controller 125 may send an error code indicating that excessive hysteresis is detected.

Figure 16:
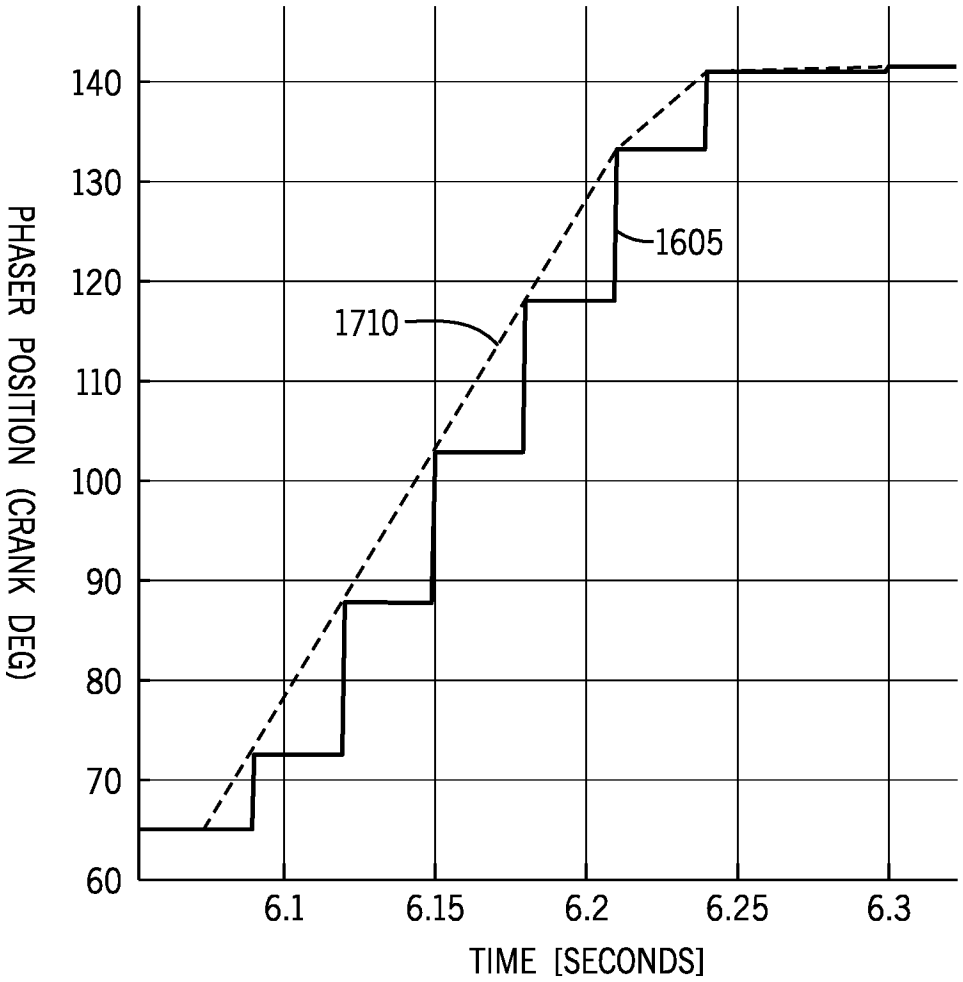
FIG. 16 is a graph showing phaser position estimation of the cam phasing system of FIG. 1.
Figure 17:
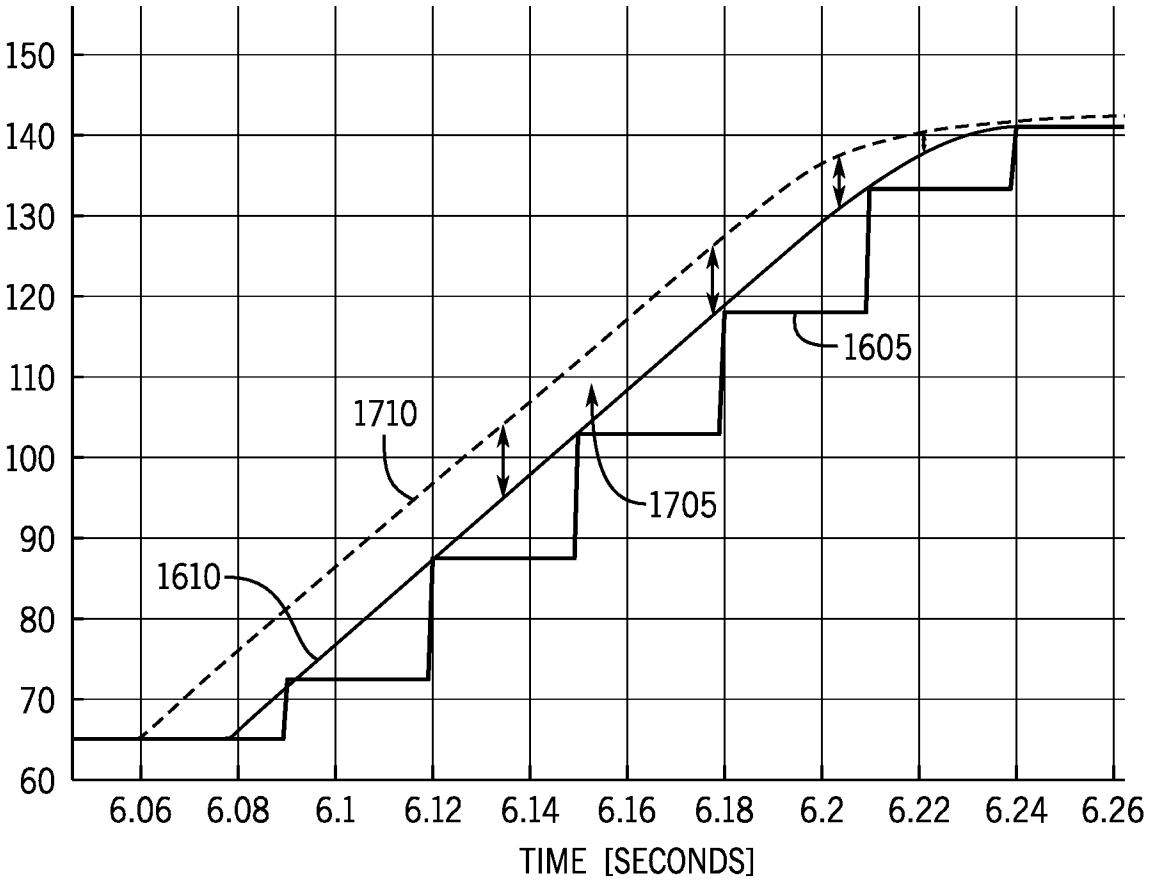
FIG. 17 is a graph showing elasticity estimation of the cam phasing system of FIG. 1.
Figure 18:
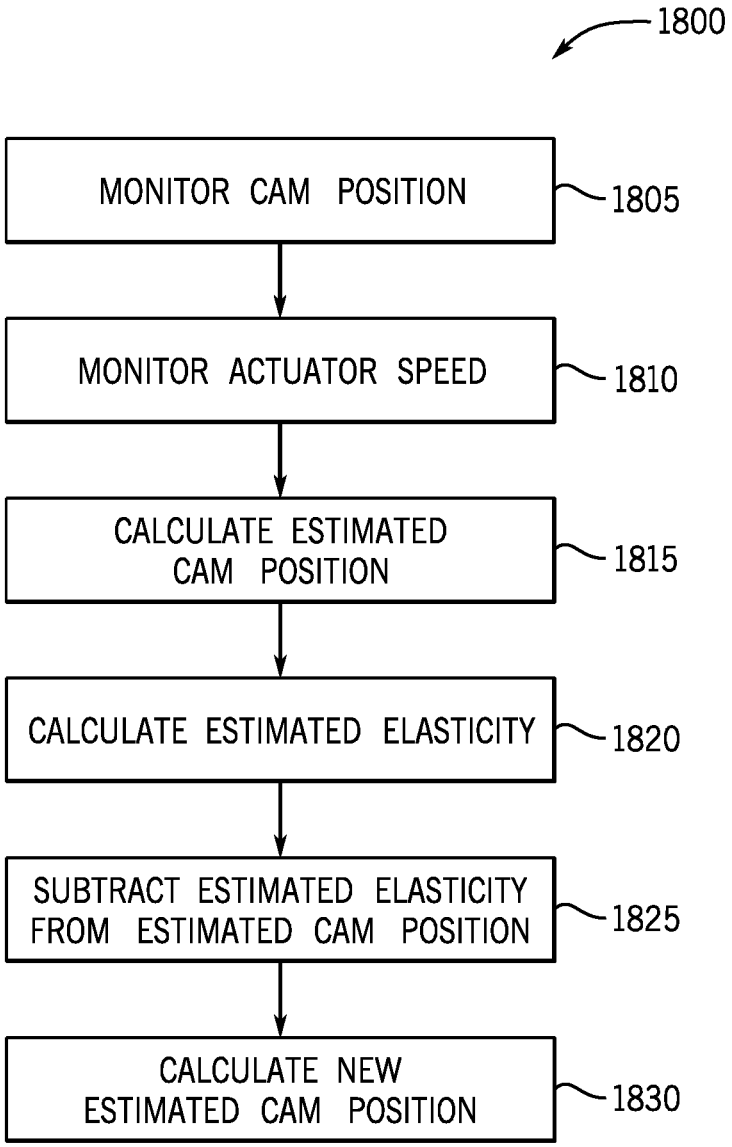
FIG. 18 is a flowchart of the phaser position estimation of FIG. 16 and the elasticity estimation of FIG. 17.

FIG. 18 shows a flowchart describing a process 1800 illustrated in FIGS. 16 and 17 for estimating a cam phaser position and elasticity thereof. In particular, during operation, the frequency of the signals provided by a cam shaft position sensor and crank shaft position sensor results in period of time where the exact phase angle is unknown. Additionally, the high forces in the phasing system can result in resilient compression of the various components therein, which can result in overshoot in the phase angle when forces are removed, and the components decompress. As a result, the measured phase angle may lag the actual phase angle, particularly at lower engine speeds. Accordingly, the process 1800 can help to predict the phase angle (e.g., an estimated phaser position) and account for the resilient compression (e.g., elasticity) in the system.

For example, at stage 1805, the controller 125 monitors the cam shaft 105 position via the cam shaft position sensor 145. At stage 1810, the controller 125 monitors the actuator 120 speed. At stage 1815, the controller 125 calculates an estimated cam position shown by line 1610 using the cam shaft position values (shown by line 1605) and the actuator speed. For example, the controller 125 can be configured to interpolate between discrete phase angle measurements (e.g., discrete signals from the cam shaft position sensor 145 and the crank shaft position sensor 150). In some cases, if the operating position is in the desired threshold region (e.g., the advance region 310 or the retard region 320) for controlling the phase angle, a measured motor speed can be used to calculate a theoretical cam position using a known ratio between motor speed and cam position. This calculated value can be used as the estimated phase angle.

To avoid overshooting the desired position of the system 100, at stage 1820, the controller 125 may calculate an estimated elasticity in the system 100 (as shown by 1705 between lines 1610 and 1705). In one example, the elasticity is calculated based on the actuator speed, engine speed, and time. In another example, actuator speed may include the direction of actuator movement. At stage 1825, the controller 125 subtracts the elasticity from the estimated cam position (shown by line 1710) to generate the line 1610. At stage 1830, the line 1610, which accounts for elasticity within the system, is used to estimate the cam position in between readings from the cam position sensor. In one example, at each measured phaser position (shown by line 1605), the controller 125 may adjust one or both of the line 1710 and the line 1610 via a predetermined correction factor to maintain accuracy of the line 1610.

In some implementations, devices or systems disclosed herein can be utilized, manufactured, or installed using methods embodying aspects of the invention. Correspondingly, any description herein of particular features, capabilities, or intended purposes of a device or system is generally intended to include disclosure of a method of using such devices for the intended purposes, a method of otherwise implementing such capabilities, a method of manufacturing relevant components of such a device or system (or the device or system as a whole), and a method of installing disclosed (or otherwise known) components to support such purposes or capabilities. Similarly, unless otherwise indicated or limited, discussion herein of any method of manufacturing or using for a particular device or system, including installing the device or system, is intended to inherently include disclosure, as embodiments of the invention, of the utilized features and implemented capabilities of such device or system.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

Additionally, unless otherwise specified or limited, the terms "about" and "approximately," as used herein with respect to a reference value, refer to variations from the reference value of ±15% or less, inclusive of the endpoints of the range. Similarly, the term "substantially equal" (and the like) as used herein with respect to a reference value refers to variations from the reference value of less than ±10%, inclusive. Where specified, "substantially" can indicate in particular a variation in one numerical direction relative to a reference value. For example, "substantially less" than a reference value (and the like) indicates a value that is reduced from the reference value by 10% or more, and "substantially more" than a reference value (and the like) indicates a value that is increased from the reference value by 10% or more.

The previous description of the disclosed embodiments is provided to enable any person skilled in the art to make or use the invention. Given the benefit of this disclosure, various modifications to these embodiments will be readily apparent to those skilled in the art, and the principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A phasing system, comprising:

a cam phaser coupled between a cam shaft and a crank shaft to control a phase angle of the cam shaft relative to the crank shaft;

an actuator coupled to the cam phaser and configured to operate the cam phaser to control the phase angle; and a controller in electrical communication with the actuator, the controller including a processor and a memory, the processor configured to:

calculate a first operating point of the actuator with respect to a hysteresis band of the phasing system, the hysteresis band defining a first static boundary and a second static boundary;

determine if the actuator is within a first threshold distance of the first static boundary; and if the actuator is outside the first threshold distance of the first static boundary, command the actuator to displace across the hysteresis band to the second static boundary.

2. The system of claim 1, wherein the processor commands the actuator to operate at a high motor speed when crossing the hysteresis band.

3. The system of claim 1, wherein a position of the actuator is determined via an actuator position sensor in communication with the controller.

4. The system of claim 1, wherein, once the actuator crosses the hysteresis band, the processor commands the actuator to displace the cam shaft of the cam phasing system into a desired position.

5. The system of claim 4, wherein the position of the cam shaft is determined via a cam shaft position sensor in communication with the controller.

6. The system of claim 4, wherein, if the cam shaft is not within the desired position, the processor commands the actuator to continue to displace the cam shaft, and wherein the processor updates and stores a dynamic boundary in the memory based on a position of the actuator.

7. The system of claim 6, wherein the dynamic boundary is removed from the memory after the processor commands the actuator to cross the hysteresis band.

8. A method of controlling a cam phasing system, comprising:

calculating, via a processor, a first operating point of an actuator of the cam phasing system;

determining, via a processor, whether the actuator is within a first threshold distance of a first static boundary of a hysteresis band;

if the actuator is not within the first threshold distance, commanding, via the processor, the actuator to cross the hysteresis band; and once the actuator is within the first threshold distance of the first static boundary of the hysteresis band, driving the actuator to displace a cam shaft of the cam phasing system into a desired position.

9. The method of claim 8, wherein the hysteresis band is defined by a distance between the first static boundary and a second static boundary of the hysteresis band.

10. The method of claim 8, wherein the processor commands the actuator to operate at a high motor speed when crossing the hysteresis band.

11. The method of claim 8, wherein driving the actuator to displace the cam shaft into the desired position includes:

determining the position of the cam shaft via a cam shaft position sensor in communication with the processor.

12. The method of claim 8, further comprising:

if the cam shaft is not at the desired position, continuing to displace the cam shaft via the actuator; and updating, via the processor, a dynamic boundary of the system based on the actuator position.

13. The method of claim 12, wherein the dynamic boundary is erased after the actuator crosses the hysteresis band.

14. The method of claim 8, wherein the position of the actuator is determined via an actuator position sensor in communication with the controller.

15. The method of claim 8, wherein driving the actuator includes:

driving the actuator to a conservative boundary; and wherein continuing to drive the actuator includes:

driving the actuator past the conservative boundary towards the first or second static boundary.

16. A method of controlling a cam phasing system, comprising:

monitoring, via an actuator position sensor in communication with a processor, a position of an actuator of the cam phasing system;

determining, via the processor, whether the position of the actuator is outside of a hysteresis band of the cam phasing system; and if the position of the actuator is outside of the hysteresis band, updating, via the processor, the hysteresis band to include the position of the actuator.

17. The method of claim 16, further comprising:

sending, via the processor, an error message when the position of the actuator is outside of a predetermined hysteresis threshold.

18. The method of claim 17, wherein the cam phasing system continues to operate after sending the error message.

19. The method of claim 16, wherein the hysteresis band is defined by a distance between a first static boundary and a second static boundary of the hysteresis band.

* * * * *